US006456266B1

(12) United States Patent
Iba et al.

(10) Patent No.: US 6,456,266 B1
(45) Date of Patent: Sep. 24, 2002

(54) LIQUID CRYSTAL DISPLAY APPARATUS

(75) Inventors: Jun Iba, Yokohama; Katsumi Komiyama, Isehara; Shigeyuki Matsumoto, Atsugi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/343,184

(22) Filed: Jun. 30, 1999

(30) Foreign Application Priority Data

Jun. 30, 1998 (JP) ..... 10-184288
Jun. 30, 1998 (JP) ..... 10-184289

(51) Int. Cl.[7] ..... G09G 3/36

(52) U.S. Cl. ..... 345/87; 345/95; 345/96; 345/97; 345/101; 345/210; 349/61; 349/74; 378/98.8

(58) Field of Search ..... 345/87, 95, 96, 345/97, 101, 210; 378/98.8; 349/61, 74

(56) References Cited

U.S. PATENT DOCUMENTS 5,675,351 A * 10/1997 Kaneko et al. ..... 345/87
5,818,419 A * 10/1998 Tajima et al. ..... 347/147
6,094,243 A * 7/2000 Yasunishi ..... 349/33

OTHER PUBLICATIONS

H. Ishigura et al., "Consideration on Motion Picture Quality of the Hold Type Display with an octuple–rate CRT", Technical Report of IEICE (Institute of Electronics Information and Communication Engineers, Japan,) EID 96–4 (Jun. 1996) pp. 19–26. (with Abstract).

* cited by examiner

*Primary Examiner*—Richard Hjerpe
*Assistant Examiner*—Jean Lesperance
(74) *Attorney, Agent, or Firm*—Fitzpatrick, Cella, Harper & Scinto

(57) ABSTRACT

The motion picture quality of liquid crystal display apparatus is improved by placing a non-display period depending on the responsiveness of the liquid crystal and a backlight source. For this purpose, a sub-period is set, within one frame period, for displaying a luminance corresponding to prescribed picture data so as to provide a time integral of luminance corresponding to a maximum luminance not exceeding a certain threshold, and another sub-period for displaying a lower luminance is placed in the same one frame period.

20 Claims, 20 Drawing Sheets

LIQUID CRYSTAL DISPLAY APPARATUS

FIELD OF THE INVENTION AND RELATED ART

The present invention relates to a liquid crystal display apparatus suitable for a motion picture display, such as a television picture display.

Various liquid crystal materials have been used for liquid crystal display apparatus, such as nematic liquid crystal, smectic liquid crystal and polymer dispersion liquid crystal.

A TN (twisted nematic)-mode liquid crystal device using a nematic liquid crystal among these liquid crystals requires a long response time of 50 to several hundred ms (millisecond) in a halftone display, so that the response is not completed within one frame period (e.g., 16.7 ms at 60 Hz) and a motion picture is sometimes blurred because of image flow, thus providing an inferior "sharpness of motion picture" to be unsuitable for a motion picture display such as television picture display.

On the other hand, a liquid crystal device using a smectic liquid crystal having a spontaneous polarization and an OCB (optically compensated bend)-mode liquid crystal device utilizing a bend alignment state of a nematic liquid crystal exhibit a response time which is one tenth to one thousandth as short as that of the conventional TN-mode liquid crystal device, thus being able to complete a response within one frame period and therefore expected to be suitable for motion picture display.

In recent years, however, it has been found that a short response time alone is not sufficient for providing "sharpness of motion picture". As described in H. Ishiguro et al., "Consideration on Motion Picture Quality of the Hold Type Display with an octuple-rate CRT", Technical Report of IEICE (Institute of Electronics Information And Communication Engineers, Japan), EID 9–64 (1996–06) pp. 19–26, a continuous lighting-type display apparatus (hereinafter referred to as "hold-type display apparatus") like a conventional liquid crystal display is in principle inferior in motion picture quality compared with a pulse lighting-type display apparatus (hereinafter called a non-hold-type display apparatus) such as a CRT (cathode ray tube). Accordingly, as described in the paper, it has been known that the motion picture quality of a hold-type display apparatus wherein a picture is ordinarily displayed continually over one frame period, can be improved by placing a portion of the period in a non-display state. Further, the picture quality can be improved at a high picture display frequency of, e.g., 120 Hz, higher than 60 Hz.

According to our study, however, even when a hold-type display apparatus is operated in a substantially non-hold type display mode by placing a non-display period, there has been found a problem that the motion picture quality can be deteriorated at different levels depending oh the responsiveness of the liquid crystal and the back light source. Further, it has been also found that the motion picture quality is also affected by other factors, such as the pixel size, luminance and contrast of the display apparatus.

SUMMARY OF THE INVENTION

In view of the above-mentioned problems, a principal object of the present invention is to provide a liquid crystal display apparatus with an improved motion picture quality.

A more specific object of the present invention is to provide a liquid crystal display apparatus with a motion picture quality improved depending on the responsiveness (response time) of the liquid crystal.

Another object of the present invention is to provide a liquid crystal display apparatus with a motion picture quality improved depending on the pixel size, luminance and contrast of the liquid crystal device.

According to the present invention, there is provided a liquid crystal display apparatus, comprising:

a liquid crystal device including a pair of substrates and a layer of liquid crystal disposed between the substrates so as-to form a matrix of pixels, and drive means for driving each pixel in a succession of frame periods each having a duration of Fr and divided into a first period and a second period in succession so as to display a first luminance in the first period and a second luminance below the first luminance in the second period under a condition satisfying: $Tap+(\tau_{off}-\tau_{on})/2Fr=Ts\leqq 0.6$, wherein Tap represents a time aperture ratio determined as a ratio between the first period and one frame period Fr, $\tau_{on}$ represents a rise time required for a luminance change of from 0% to 90% during a switching from 0%-luminance to 100%-luminance, and $\tau_{off}$ represents a fall time required for a luminance change of from 100% to 10% during switching from 100%-luminance to 0%-luminance based on a normalized luminance scale with 100% at a maximum luminance and 0% at a minimum luminance of each pixel.

According to another aspect of the present invention, there is provided a liquid crystal display apparatus, comprising:

a liquid crystal device including a pair of substrates and a layer of liquid crystal disposed between the substrates so as to form a matrix of pixels, and drive means for driving each pixel in a succession of frame periods each having a duration of Fr and divided into a first period and a second period in succession so as to display a first luminance in the first period and a second luminance below the first luminance in the second period under condition satisfying: $Tap+\tau_{off}/2Fr=Ts\leqq 0.65$, wherein Tap represents a time aperture ratio determined as a ratio between the first period and one frame period Fr, $\sigma_{off}$ represents a fall time required for a luminance change of from 100% to 10% during switching from 100%-luminance to 0%-luminance based on a normalized luminance scale with 100% at a maximum luminance and 0% at a minimum luminance of each pixel.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment

Figure 1A:
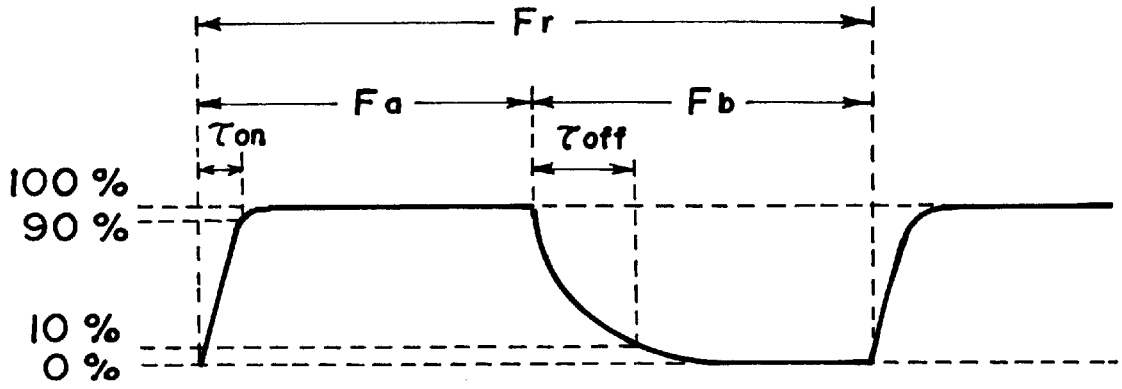
FIG. 1A is a waveform diagram for illustrating a response characteristic of a liquid crystal display apparatus according to the present invention.

First of all, a function of the liquid crystal display apparatus according to the present invention will be described with reference to FIGS. 1A and 1B. FIG. 1A is a waveform diagram showing a luminance change with time of a liquid crystal display apparatus according to the present invention when a 100%-display is effected in a first period and a 0%-display is effected in a second period at an arbitrary pixel on a scale that the maximum luminance and the minimum luminance displayable by (each pixel of) the display apparatus are denoted at 100% and 0%, respectively. In FIG. 1A, Fr denotes a frame (period); Fa, a first period; and Fb, a second period.

In the present invention, as shown in FIG. 1A, one frame period is divided into a first period and a second period, whereby a first luminance is displayed in the first period and a second luminance lower than the first luminance is displayed in the second period. The first luminance is a luminance corresponding to prescribed picture data to be displayed, and in the present invention, a second period for displaying a second luminance below the first luminance is placed to effect a non-hold display. The second luminance may preferably be at most ca. 10%, more preferably substantially 0%.

More specifically, the control from the first luminance to the second luminance may be effected by a method of controlling a transmittance through a liquid crystal layer or a method of controlling ON and OFF of a backlight source, as will be described later. In any case, some period is required until a prescribed luminance is reached by a display luminance change. Now, a rising period (rise time) required until a 90%-display in case of display change from 0% to 100% is denoted by $\tau_{on}$, and an attenuation period (fall time) required until a 10%-display in case of display change from 100% to 0% is denoted by $\tau_{off}$.

We have obtained a knowledge that a motion picture quality-improvement effect in a non-hold display depends on an integral of luminance displayed in one frame period.

Figure 1B:
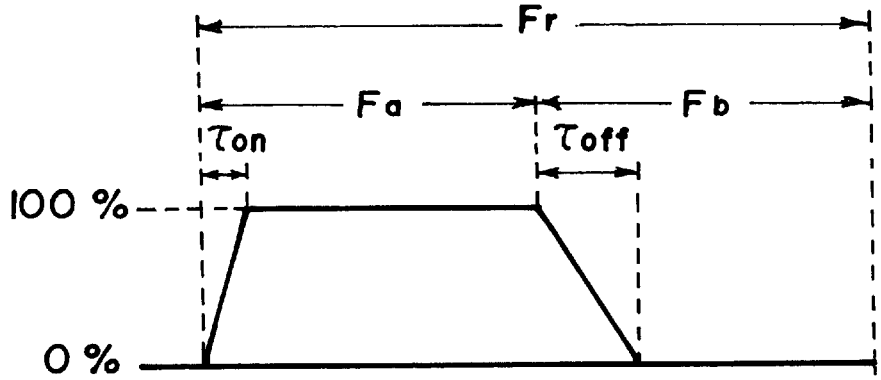
FIG. 1B shows an approximation of the response characteristic in FIG. 1A.

The waveform of FIG. 1A is approximated by one shown in FIG. 1B. As a result, the luminance integral in one frame of FIG. 1A is approximated as follows based on the linear waveform in FIG. 1B:

$$(\tau_{on}/2)+(Fa-\tau_{on})+(\tau_{off}/2).$$

Now, a relationship of Fa=Tap×Fr (wherein Tap denotes an aperture time ratio) is substituted in the above, the luminance integral is as follows:

$$=(\tau_{on}/2)+(Tap\times Fr-\tau_{on})+(\tau_{off}/2)$$

$$=Tap\times Fr+(\tau_{off}-\tau_{on})/2Fr,$$

The luminance integral may be normalized by one frame period Fr as follows.

$$Tap+(\tau_{off}-\tau_{on})/2Fr.$$

In the present invention, the thus-normalized luminance integral Ts is set to be 0.6 or smaller, i.e., $$Tap+(\tau_{off}-\tau_{on})/2Fr=Ts\leqq 0.6.$$

More specifically, in the present invention, a display time integral corresponding to a 100%-display including the response time within one frame period is set to be a certain threshold value (0.6) or below, the motion picture quality can be improved depending on the response time $\tau_{on}$ and $\tau_{off}$. It is preferred that Ts≦0.45.

The value Ts may preferably be reduced as close to 0 as possible from the viewpoint of improving the motion picture quality, but should preferably be set to be ca. 0.05 at the minimum in view of the available display picture luminance level.

In the present invention, the motion picture quality is improved by suppressing the above integral value Ts, so that $\tau_{off}$ should be shorter than the second period. In other words, the minimum of the second luminance in the second period should be at most 10% , preferably sufficiently attenuated to provide a 0%-display.

In the present invention, as will be described hereinafter, the second luminance may be controlled by a transmittance change of a liquid crystal layer or by turning on and off of a backlight source. In the former case, the luminance control is effected by appropriately changing the transmittance through a liquid crystal layer while continually illuminating the liquid crystal device with a constant intensity of light for a reflection-type device or continually energizing the backlight source for a transmission type device. Accordingly, in the first period, the liquid crystal layer at each pixel is controlled to show a transmittance corresponding to picture data thereat by applying a prescribed voltage thereto, and in the second period, the transmittance through the liquid crystal layer is controlled to provide a transmittance lower than in the first period by changing the voltage applied to the liquid crystal layer. Accordingly, in this system, if a maximum transmittance and a minimum transmittance through the liquid crystal layer are taken at 100% and 0%, respectively, the above-mentioned $\tau_{on}$ corresponds to a rising period of transmittance change from 0% to 90% in case of switching from 0%-transmittance to 100%-transmittance, and $\tau_{off}$ corresponds to an attenuation period of transmittance change from 100% to 10% in case of switching from 100%-transmittance to 0%-transmittance.

On the other hand, in the system of second luminance control by turning ON and OFF of a backlight source, the first period is taken as an ON period (lighting period) and the second period is taken as an OFF period (non-lighting period). Then, by using the second period of a previous frame, the liquid crystal layer is supplied with prescribed voltages so as to provide transmittances corresponding to picture data at the respective pixels, and in the first period of a current frame subsequent to the previous frame, the backlight source is turned on to display luminances at the respective pixels corresponding to the picture data. Then, in the second picture of the current frame, the backlight source is turned off to provide a second luminance below the first luminance. Accordingly, in this system, the above-mentioned Ton corresponds to a rising period of luminance change from 0% to 90% of the backlight source in case of turning on the backlight source and $\tau_{off}$ corresponds to an attenuation period of luminance change from 100% to 10% of the backlight source in case of turning off the backlight source.

As mentioned above, the motion picture quality deteriorates at different degrees depending on the pixel size, luminance and contrast. First of all, regarding the pixel size, each display unit pixel may preferably be have a lateral length (a length along a scanning line) Sz (m) (which has a visually larger influence on the motion picture quality than a vertical size) satisfying:

$$Ts \times Sz/(300 \times 10^{-6}) \leqq 0.6,$$

preferably $$Ts \times Sz/(300 \times 10^{-6}) \leqq 0.5.$$

The picture display speed becomes faster as the pixel size is larger, and the motion picture quality deteriorates substantially in proportion to an increase in display speed. This tendency is substantially identical to the relationship between Ts and the motion picture quality and independently holds. Accordingly, the motion picture quality can be stipulated by the product of these factors. Incidentally, the motion picture quality is visually affected in a larger degree by a lateral size than by a vertical size, so that the definition of a lateral size is convenient. Herein, a display unit pixel refers to a minimum unit of display and, in the case of a monochromatic display, refers to a pixel as a minimum unit capable of changing the transmittance. On the other hand, in the case of a full-color display using three colors of R (red), G (green) and B (blue) or four colors further including W (white), a unit of the three or four color pixels in combination provides a display unit pixel, so that the pixel size is determined by a distance between the gravity centers of a pair of adjacent display unit pixels, and the length in the lateral direction is determined as Sz.

Then, the display picture may preferably be designed to provide a luminance Br (cd/m$^2$) satisfying:

$$Ts \times log(Br) \leqq 1.3,$$

more preferably, $$Ts \times log(Br) \leqq 1.0.$$

According to human eyes characteristics, the luminance is recognized nearly on a logarithmic scale, so that at a higher luminance, the motion picture quality deteriorates proportionally. This relationship holds true independently of the relationship between Ts and the motion picture quality, and accordingly the motion picture quality can be controlled depending on a product of these factors.

Further, the display contrast Cr may preferably be set to satisfy:

$$Ts \times log(Cr) \leqq 1.2,$$

more preferably, $$Ts \times log(Cr) \leqq 0.9.$$

According to human eyes characteristics, the contrast, similarly as the luminance, is recognized nearly in a logarithmic scale, so that at a higher contrast, the motion picture quality deteriorates proportionally. This relationship also holds true independently of the relationship between Ts and the motion picture quality, and a higher motion picture quality can be obtained by controlling both factors.

Then, a specific embodiment of the liquid crystal device according to the present invention will be described with reference to the drawings.

Figure 2:
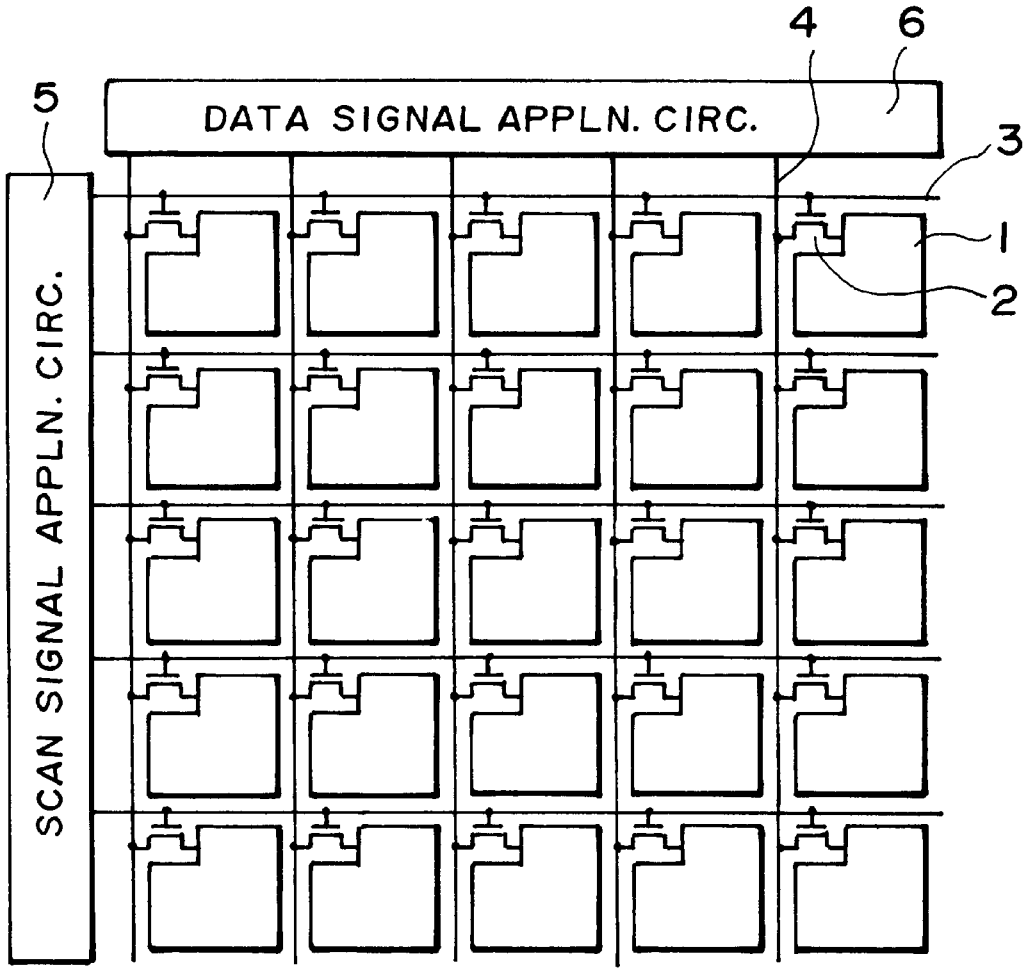
FIG. 2 is a schematic plan view of an embodiment of the liquid crystal display apparatus according to the invention.

FIG. 2 is a schematic plan view of an embodiment of the liquid crystal display apparatus according to the present invention. Referring to FIG. 2, the display apparatus includes a matrix of pixel electrodes 1 each provided with a TFT (thin film ransistor) 2 which is connected via a scanning signal line 3 to a scanning signal application circuit 5 and via a data signal line 4 to a data signal application circuit 6. This embodiment is an active matrix-type display apparatus wherein each pixel is provided with a TFT as an an active element. As shown in FIG. 2, a plurality of pixel electrodes 1 are arranged in a matrix. The gate electrodes of the TFTs 2 each provided to one pixel electrode are connected to the scanning signal lines 3, and the source electrodes of the TFTs 2 are connected to the data signal lines 4 in the form of a matrix wiring. The respective scanning signal lines 3 are sequentially supplied with a scanning selection signal (a turn-on signal for TFTs 2 connected to a selected scanning signal line) from the scanning signal application circuit 5. In synchronism with the scanning selection signal, data signals during prescribed gradation data are applied from the data signal application circuit 6 via the data signal lines 4 to the pixel electrodes 1 on the selected line 3 to apply corresponding voltages to the liquid crystal layer to effect a display at pixels on the selected line.

Figure 3:
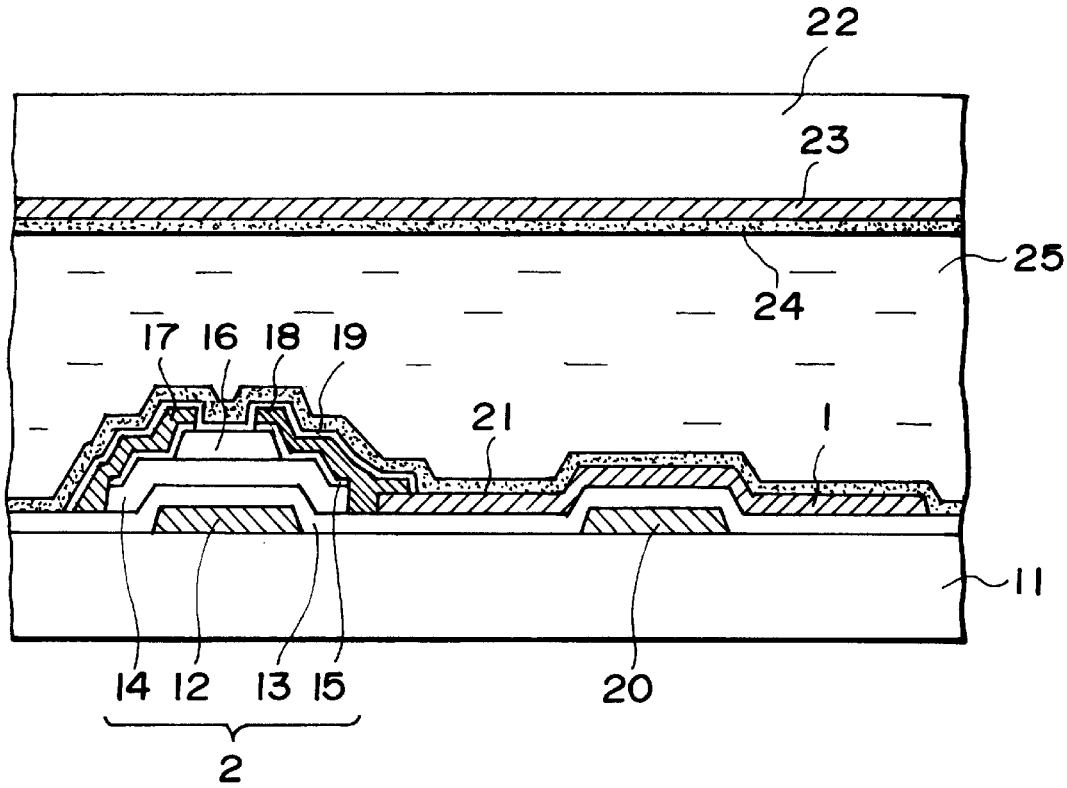
FIG. 3 is a schematic sectional view of one pixel portion of a liquid crystal device used in the invention.

FIG. 3 shows a sectional view of nearly one pixel of a liquid crystal device constituting a liquid crystal display apparatus as shown in FIG. 2.

Referring to FIG. 3, each pixel of the liquid crystal device comprises a substrate 11, a TFT 2 disposed on the substrate 11 and comprising a gate electrode 12, a gate insulating film 13, a semiconductor layer 14, an ohmic contact layer 15, an insulating layer 16, a source electrode 17, a drain electrode 18 and a passivation film 19, a pixel electrode 1 connected to the drain electrode 18, a retention capacitor electrode 20, an alignment film 21 disposed over the above-mentioned members, a counter substrate 22 having thereon a common electrode 23 and an alignment film 24, and a liquid crystal 25 disposed between the alignment films 22 and 24.

Referring to FIG. 3, in the case of a transmission-type liquid crystal device, the substrate 11 is a transparent one comprising ordinarily glass or plastic, and in the case of a reflection-type device the substrate 11 can be an opaque substrate comprising, e.g., silicon, in some cases. The pixel electrodes 1 and the common electrode 23 comprise a transparent conductor, such as ITO (indium tin oxide) in the case of a transmission type but the pixel electrodes 31 can comprise a metal having a high reflectivity so that it also functions as a reflector in the case of a reflection type. The semiconductor layer 14 may generally comprise amorphous (a-)Si.

Alternatively, it is also possible to preferably use polycrystalline (p-)Si. The ohmic contact layer 15 may for example be formed of an $n^+$a-Si layer. The gate insulating film 13 may comprise silicon nitride ($SiN_x$), etc. Further, the gate electrode 12, source electrode 17, drain electrode 18, retention capacitor electrode 20, and lead conductors, may generally comprise a metal, such as Al. As for the retention capacitor electrode 20, it can some times comprise a transparent conductor, such as ITO. The insulating layer 26 and the passivation layer 29 may preferably comprise an insulating film of, e.g., silicon nitride. The alignment films 21 and 24 may be formed of a material appropriately selected depending on the liquid crystal material and drive mode used, and may for example comprise a rubbed film of a polymer, such as polyimide or polyamide, e.g., for homogeneous alignment of a smectic liquid crystal.

As a preferred example, a smectic liquid crystal having a spontaneous polarization, e.g., a threshold-less anti-ferroelectric liquid crystal (TAFLC) may be used for effecting a good gradational display. More specifically, TATFLC is an anti-ferroelectric liquid crystal having a transmittance characteristic which continuously changes in response to applied voltage change and does not show a clear threshold. Accordingly, by controlling the voltage applied to the liquid crystal, the transmittance can be continuously changed.

In addition, it is possible to use a nematic liquid crystal according to the OCB-mode. In the OCB-mode cell, a bend alignment mode is used, wherein liquid crystal molecules are aligned with a pretilt angle at boundaries with the substrates and aligned in parallel with a normal to the substrates in a middle portion of the liquid crystal layer in the normal direction. In the OCB-mode cell, a pair of substrates are provided with homogeneous alignment films rubbed in directions which are parallel or substantially parallel to each other, whereby liquid crystal molecules are placed in a splay alignment wherein liquid crystal molecules are generally aligned in a plane parallel with the rubbing directions (or an average of the rubbing directions when they intersect at some angle) to form a pretilt angle at boundaries with the substrates. When a prescribed bending voltage is applied to the liquid crystal layer in the state, the liquid crystal is realigned into a bend alignment wherein liquid crystal molecules in a middle portion along a normal to the substrates are aligned parallel to the normal and, at positions closer to the substrates, the liquid crystal molecules assume angles closer to the pretilt angle. The bend alignment can be retained at a holding voltage which is lower than the above-mentioned bending voltage, and when supplied with a voltage higher than the holding voltage, the liquid crystal molecules are-realigned into a quasi-homeotropic alignment wherein the liquid crystal molecules are aligned parallel to a normal to the substrates over a major portion of the liquid crystal layer thickness except for the vicinities of the substrates. The response between the quasi-homeotropic alignment and the bend alignment is fast, and also intermediate states are possible, whereby a gradational display can be effected by changing the applied voltage while taking the holding voltage as a lower-side voltage.

In the present invention, in addition to the OCB-mode liquid crystal device, it is also possible to appropriately use a conventional TN-mode liquid crystal device, an anti-ferroelectric liquid crystal device showing three stable states, a DHF (deformed helix ferroelectric) liquid crystal device, etc.

In the case of using a TN-mode liquid crystal device or an OCB-mode liquid crystal device, either a normally black-mode display or a normally white-mode display can be suitably used. Incidentally, in the case of a nematic liquid crystal device, a normally white-mode display provides a better motion picture quality because $\tau_{off}$ is shorter than $\tau_{on}$.

In the above embodiment, TFTs are used as active elements, but it is also possible to use two-terminal elements such as MIM devices.

Figure 4:
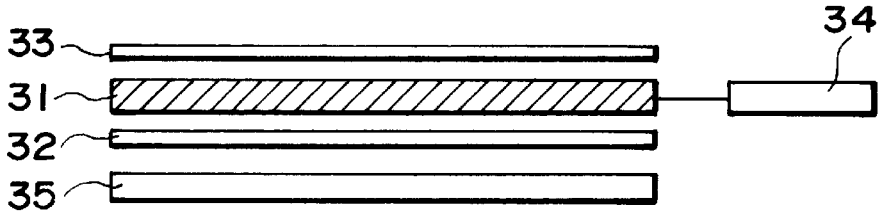
FIG. 4 is a stacked view of a liquid crystal display apparatus of the invention formed as a transmission-type device.

FIG. 4 illustrates a stacked structure of a transmission-type liquid crystal display apparatus according to the present invention, including a liquid crystal device 31, pair of polarizers 32 and 33, a drive circuit 34 for the liquid crystal device 31, and a backlight source 35. In the case of controlling the second luminance by controlling the transmittance through a liquid crystal layer in the present invention, either of the transmission-type and the reflection-type can be used. Further, in the case of transmission-type, the backlight source is continuously turned on so that it is possible to use a white light source ordinarily used in liquid crystal display apparatus. On the other hand, the mode of controlling the second luminance by turning on and off of a backlight source is only applicable to the transmission-type device, and a backlight source capable of accurate control of turning on and off is required.

Figure 5:
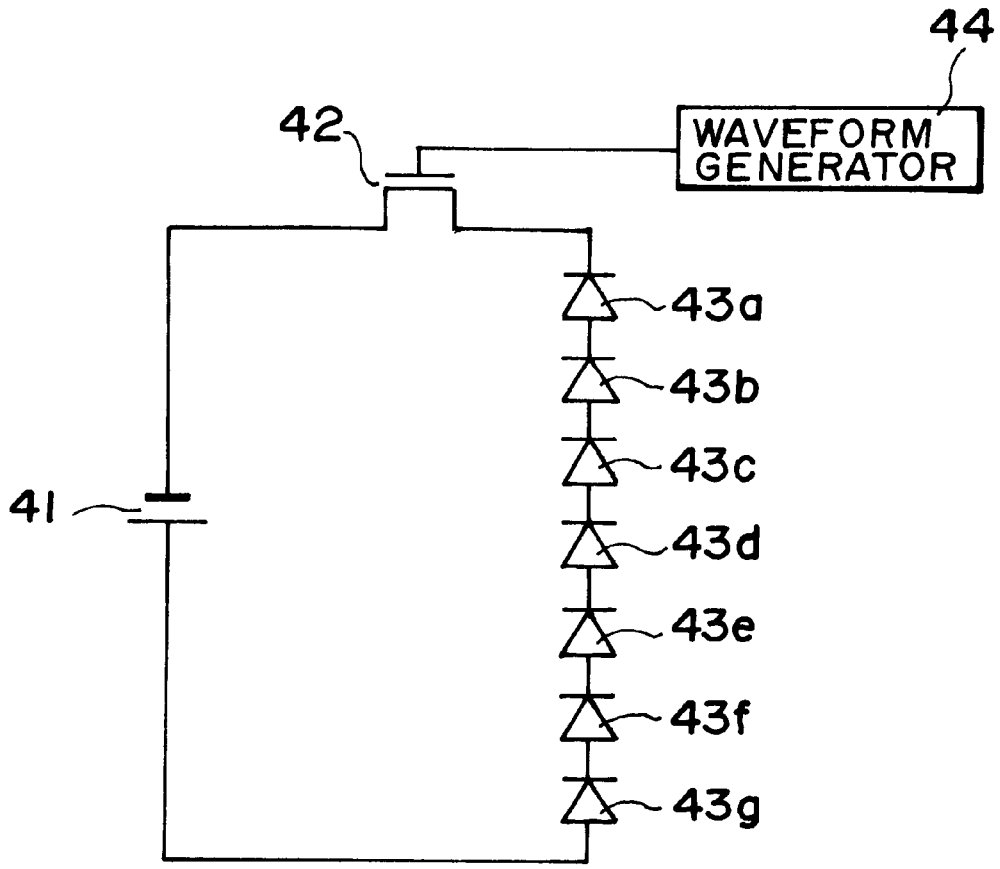
FIG. 5 is a lighting circuit for a backlight source usable in the invention.

FIG. 5 shows a drive circuit for such a backlight source. A white backlight source is composed of, e.g., a set of LEDs of R, G and B. The drive circuit includes a power supply 41, a transistor 42, LEDs 43*a*–43*g*, and a waveform generator 44. Monochromatic light sources of LEDs 43*a*–43*g* arranged in a plurality in series. In this embodiment, 7 LEDs for each color and totally 21 LEDs are used. The gate voltage to the transistor 42 is regulated by the waveform generator 44 to supply a controlled current to LEDs 43*a*–43*b*. As light source materials, GaAlAs is used for R, and GaN is used for G and B. By using such LEDs having a response time on the order of several $\mu$sec, the lighting time (ON-time) for the backlight source can be arbitrarily set. In the present invention, however, it is also possible to use cold cathode ray tubes (fluorescent lamps), hot cathode ray tubes or halogen lamps.

In addition to the above-described liquid crystal display apparatus organization, it is also possible to apply conventional techniques for liquid crystal display devices as far as the time (period) adjustment according to the present invention is possible.

Figure 6:
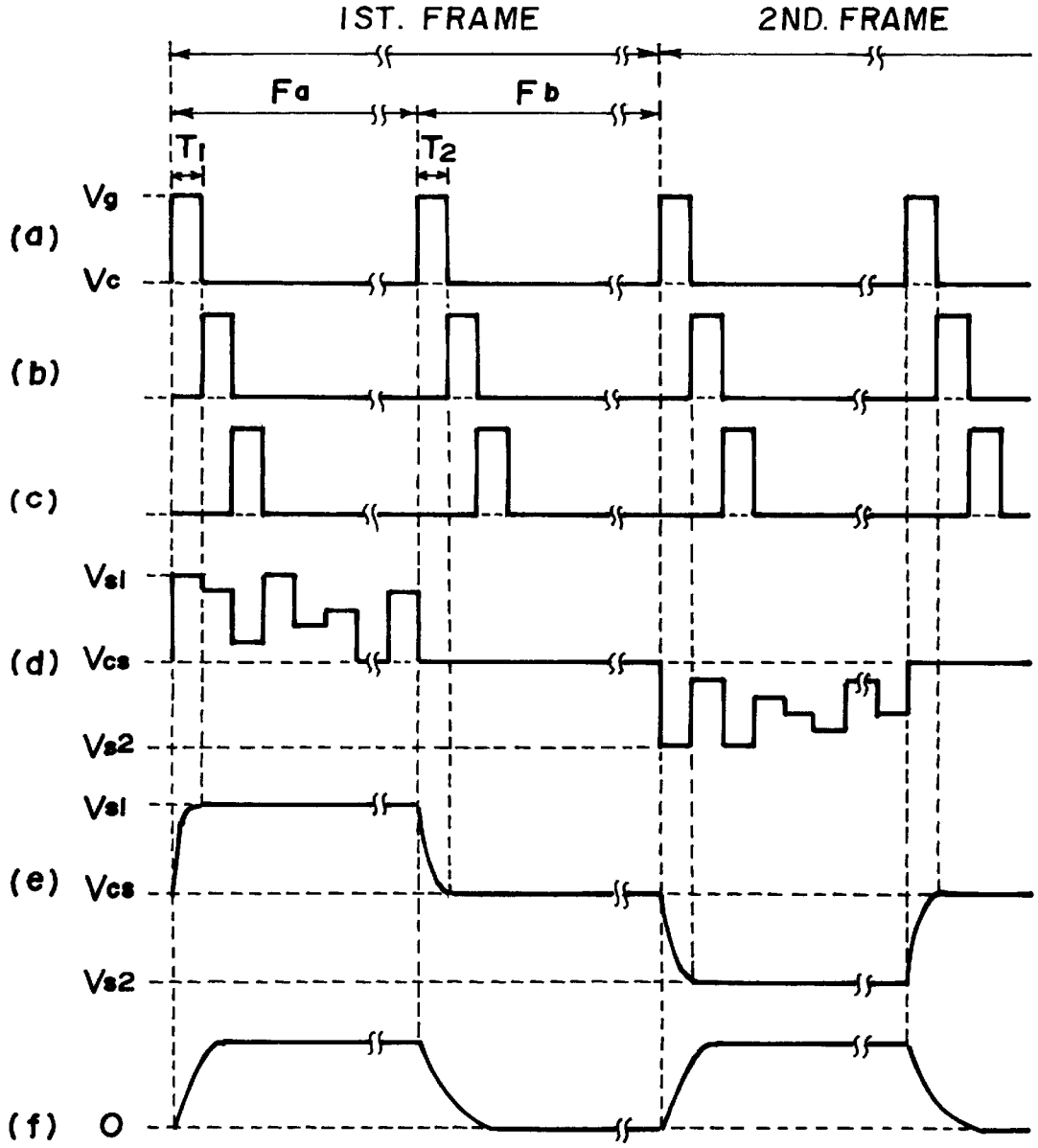
FIG. 6 shows an example set of drive signal waveforms for a liquid crystal display apparatus of the invention.
Figure 7:
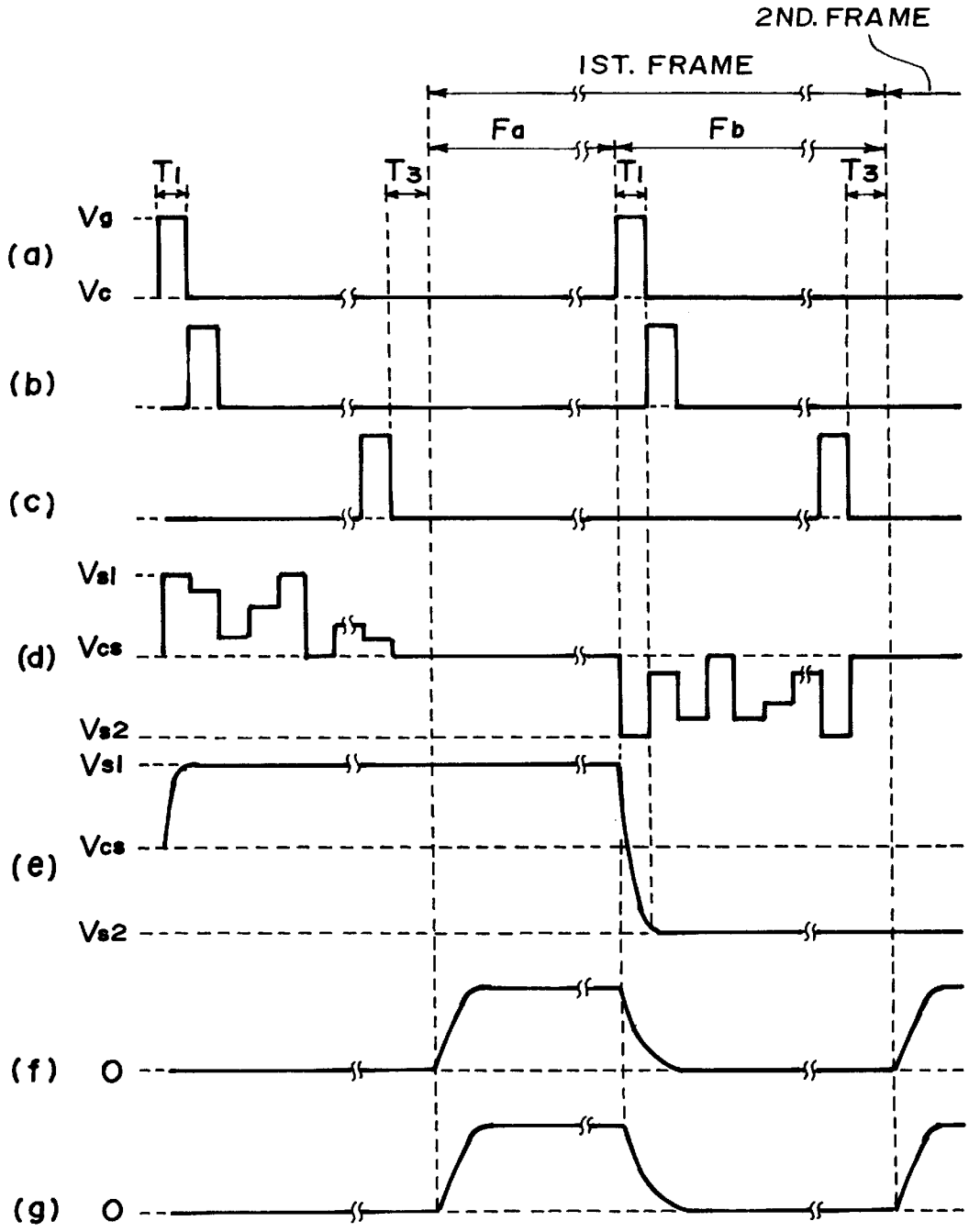
FIG. 7 shows another example set of drive signal waveforms for a liquid crystal display apparatus of the invention.
Figure 8:
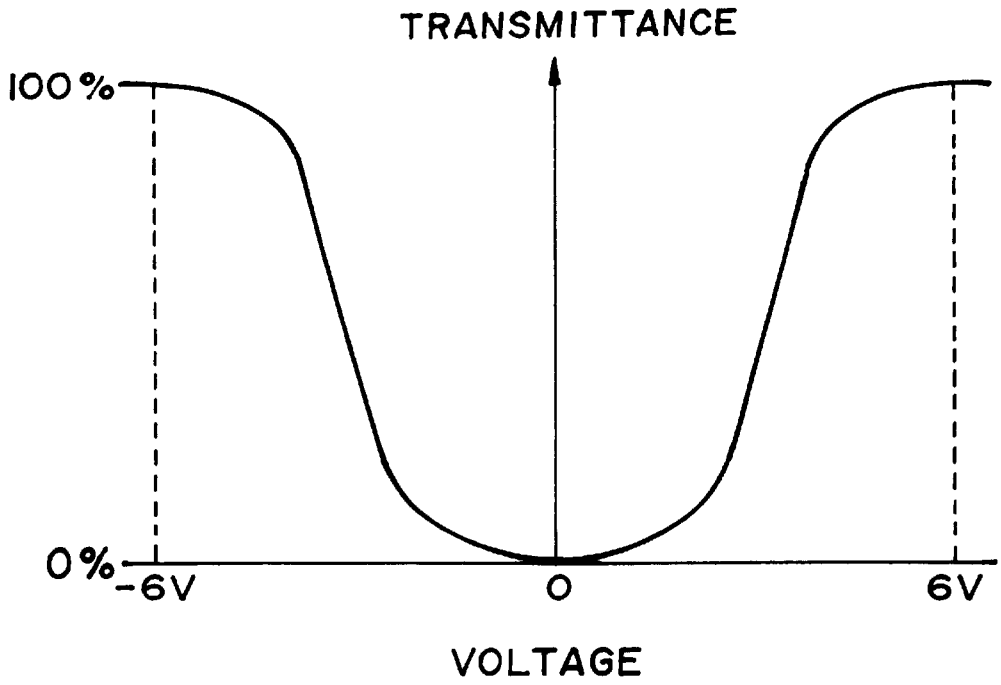
FIG. 8 shows a voltage-transmittance characteristic cure of an anti-ferroelectric liquid crystal usable in the invention.

FIGS. 6 and 7 are time-serial waveform diagrams each showing an example set of waveforms for driving an active matrix-type liquid crystal device described with reference to FIGS. 2 and 3 and using TAFLC showing a voltage-transmittance characteristic as shown in FIG. 8. FIG. 6 shows waveforms used in the mode of controlling the second luminance by changing the transmittance through a liquid crystal layer while continually turning on the backlight source, and FIG. 7 shows waveforms in the mode of controlling the second luminance by turning on and off of the backlight source. These waveforms are explained sequentially in further detail.

Referring to FIG. 6, at (a)–(c) are shown scanning signal waveforms applied to first to third scanning signal lines, respectively; and (d) is shown a data signal applied to a first data signal line; at (e) is shown a voltage waveform applied to a pixel at an intersection of the first row and the first column; and at (f) is shown a luminance change at the pixel.

As shown in FIG. 6, in a first period Fa in a first frame, the scanning lines are sequentially selected to apply a gate-on signal (Vg relative to a reference voltage Vc) having a pulse width T1 to sequentially selected scanning lines. In synchronism with each selection of a scanning line, data signals having set values within a range of $V_{s1}$ to $V_{s2}$ relative to a reference voltage Vcs are applied to the respective data lines. As a result, associated pixels on the selected scanning lines are supplied with voltages carrying prescribed gradation data, and prescribed luminances are displayed at the pixels. Then, in a second period Fb, scanning lines are sequentially selected to apply a voltage corresponding to a 0%-luminance to all the pixels, whereby the luminances at the pixels are sequentially attenuated line by line.

In this embodiment, the first period Fa is set corresponding to the response time of the liquid crystal.

On the other hand, in FIG. 7 for illustrating another set of drive signal waveforms, at (a)–(c) are shown scanning signal waveforms applied to a first, a second and a final scanning signal line, respectively; and (d) is shown a data signal applied to a first data signal line; at (e) is shown a voltage waveform applied to a pixel at an intersection of the first row and the first column; at (g) is shown a luminance change at the pixel; and at (f) is shown a luminance change of the backlight source.

As shown in FIG. 7, in a previous frame prior to a first frame, the scanning lines are sequentially selected to apply a gate-on signal (Vg relative to a reference voltage Vc) T1 to sequentially selected scanning lines. In synchronism with each selection of a scanning line, data signals having set values within a range of $V_{s1}$ to $V_{s2}$ relative to a reference voltage Vcs are applied to the respective data lines. As a result, associated pixels on the selected scanning lines are supplied with voltages carrying prescribed gradation data, and prescribed transmittances are established at the pixels. Until this point of time, the backlight is kept off. After taking a time required for complete switching of the liquid crystal, the backlight is turned on in a first period in a first frame. As the respective pixels already assume respective transmittances for displaying prescribed gradation data, the respective pixels display respective luminances in synchronism with the luminance rise of the backlight. Then, in a second period Fb, the backlight is turned off, whereby the luminances at the respective pixels attenuate simultaneously. During the off-period of the backlight, writing at the respective pixels in a current frame (first frame) is performed. That is, by sequentially applying a gate-on signal having a pulse width T1 to the scanning lines and in synchronism with each selection of a scanning line, prescribed data signals are applied to data signal lines, thereby establishing prescribed transmittances corresponding to prescribed gradation data at the respective pixels. Then, after placing a period T3 required for complete switching of the liquid crystal, the first period operation in a subsequent frame (second frame) is started.

In this embodiment, the first period Ta is set corresponding to the response time of the backlight.

Second Embodiment

Figure 16:
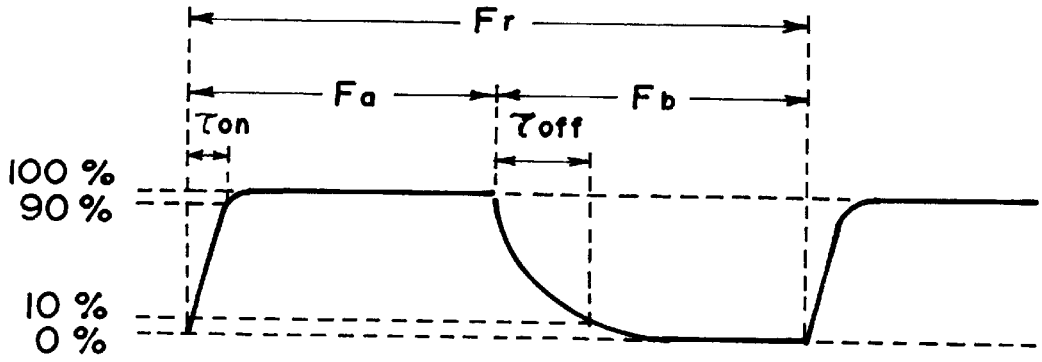
FIGS. 16 shows a luminance response characteristic of a liquid crystal display apparatus according to the present invention.

A function of the liquid crystal display apparatus according to the present invention will be described first with reference to FIG. 16. FIG. 16 is a waveform diagram showing a luminance change with time of a liquid crystal display apparatus according to the present invention when a 100%-display is effected in a first period and a 0%-display is effected in a second period at an arbitrary pixel on a scale that the maximum luminance and the minimum luminance displayable by (each pixel of) the display apparatus are denoted at 100% and 0%, respectively. In FIG. 16, Fr denotes a frame (period); Fa, a first period; and Fb, a second period.

In the present invention, as shown in FIG. 16, one frame period is divided into a first period and a second period, whereby a first luminance is displayed in the first period and a second luminance lower than the first luminance is displayed in the second period. The first luminance is a luminance corresponding to prescribed picture data to be displayed, and in the present invention, a second period for displaying a second luminance below the first luminance is placed to effect a non-hold display.

More specifically, the control from the first luminance to the second luminance may be effected by a method of controlling a transmittance through a liquid crystal layer or a method of controlling ON and OFF of a backlight source, in a similar manner as in the previous embodiment. In any case, some period is required until a prescribed luminance is reached by a display luminance change. Now, a rising period (rise time) required until a 90%-display in case of display change from 0% to 100% is denoted by $\tau_{on}$, and an attenuation period (fall time) required until a 10%-display in case of display change from 100% to 0% is denoted by $\tau_{off}$.

We have attained a knowledge that a motion picture quality in a non-hold display deteriorates in case where a first period in one frame period is elongated and also in case where $\tau_{off}$ becomes longer. Now, from FIG. 16, a displaying period is represented by $Fa+\tau_{off}$. However, as $\tau_{off}$ provides a time-integral luminance smaller compared with that given by Fa, the influence thereof on the motion period quality is smaller than in the first period. Accordingly, a display period affecting the motion picture period is represented by $Fa+\tau_{off}/a$ (a: a factor satisfying a >1).

Into this term, a relationship of Fa=Tap×Fr (wherein Tap denotes an aperture time ratio) is substituted, and the resultant term is normalized by one frame period Fr into the following term:

$$(Tap\times Fr+\tau_{off}/a)/Fr=Tap+\tau_{off}/a.Fr.$$

According to our study, the above-mentioned factor a can be approximated as 1.5, and by setting $Tap+\tau_{off}/1.5Fr=Ts\leqq 0.65$, the motion picture quality can be improved depending on the responsiveness of the liquid crystal and the light source. It is preferred to satisfy $Ts \leqq 0.45$.

The value Ts may preferably be reduced as close to 0 as possible from the viewpoint of improving the motion picture quality, but should preferably be set to be ca. 0.05 at the minimum in view of the available display picture luminance level.

In the present invention, it is preferred that the second luminance in the second period is controlled to provide a minimum of 0%.

In this embodiment, similarly as in the first embodiment, the second luminance may be controlled by a transmittance change of a liquid crystal layer or by turning on and off of a backlight source. In the former case, the luminance control is effected by appropriately changing the transmittance through a liquid crystal layer while continually illuminating the liquid crystal device with a constant intensity of light for a reflection-type device or continually turning on the backlight source for a transmission type device. Accordingly, in the first period, the liquid crystal layer at each pixel is controlled to show a transmittance corresponding to picture data thereat by applying a prescribed voltage thereto, and in the second period, the transmittance through the liquid crystal layer is controlled to provide a transmittance lower than in the first period by changing the voltage applied to the liquid crystal layer. Accordingly, in this system, if a maximum transmittance and a minimum transmittance through the liquid crystal layer are taken at 100% and 0%, respectively, the above-mentioned $\tau_{on}$ corresponds to a rising period of transmittance change from 0% to 90% in case of switching from 0%-transmittance to 100%-transmittance, and $\tau_{off}$ corresponds to an attenuation period of transmittance change from 100% to 0% in case of switching from 100%-transmittance to 0%-transmittance.

On the other hand, in the system of second luminance control by turning ON and OFF of a backlight source, the first period is taken as an ON period (lighting period) and the second period is taken as an OFF period (non-lighting period). Then, by using the second period of a previous frame, the liquid crystal layer is supplied with prescribed voltages so as to provide transmittances corresponding to picture data at the respective pixels, and in the first period of a current frame subsequent to the previous frame, the backlight source is turned on to display luminances at the respective pixels corresponding to the picture data. Then, in the second picture of the current frame, the backlight source is turned off to provide a second luminance below the first luminance. Accordingly, in this system,-the above-mentioned $\tau_{on}$ corresponds to a rising period of luminance change from 0% to 90% of the backlight source in case of turning on the backlight source and $\tau_{off}$ corresponds to an attenuation period of luminance change from 100% to 10% of the backlight source in case of turning off the backlight source.

As mentioned above, the motion picture quality deteriorates at different degrees depending on the pixel size, luminance and contrast. First of all, regarding the pixel size, each display unit pixel may preferably be have a lateral length (a length along a scanning line) Sz (m) (which has a visually larger influence on the motion picture quality than a vertical size) satisfying:

$$Ts \times Sz/(300 \times 10^{-6}) \leqq 0.65,$$

preferably $$Ts \times Sz/(300 \times 10^{-6}) \leqq 0.5.$$

The picture display speed becomes faster as the pixel size is larger, and the motion picture quality deteriorates substantially in proportion to an increase in display speed. This tendency is substantially identical to the relationship between Ts and the motion picture quality and independently holds. Accordingly, the motion picture quality can be stipulated by the product of these factors. Incidentally, the motion picture quality is visually affected in a larger degree by a lateral size than by a vertical size, so that the definition of a lateral size is convenient. Herein, a display unit pixel refers to a minimum unit of display and, in the case of a monochromatic display, refers to a pixel as a minimum unit capable of changing the transmittance. On the other hand, in the case of a full-color display using three colors of R (red), G (green) and B (blue) or four colors further including W (white), a unit of the three or four color pixels in combination provides a display unit pixel, so that the pixel size is determined by a distance between the gravity centers of a pair of adjacent display unit pixels, and the length in the lateral direction is determined as Sz.

Then, the display picture may preferably be designed to provide a luminance Br (cd/m$^2$) satisfying:

$$Ts \times log(Br) \leqq 1.4,$$

more preferably, $$Ts \times log(Br) \leqq 1.0.$$

According to human eyes characteristics, the luminance is recognized nearly on a logarithmic scale, so that at a higher luminance, the motion picture quality deteriorates proportionally. This relationship holds true independently of the relationship between Ts and the motion picture quality, and accordingly the motion picture quality can be controlled depending on a product of these factors.

Further, the display contrast Cr may preferably be set to satisfy:

$$Ts \times log(Cr) \leqq 1.3,$$

more preferably, $$Ts \times log(Cr) \leqq 0.9.$$

According to human eyes characteristics, the contrast, similarly as the luminance, is recognized nearly in a logarithmic scale, so that at a higher contrast, the motion picture quality deteriorates proportionally. This relationship also holds true independently of the relationship between Ts and the motion picture quality, and a higher motion picture quality can be obtained by controlling both factors.

This embodiment of the liquid crystal display apparatus according to the present invention may have a structurally similar organization as adopted in the first embodiment and described with reference to FIGS. 2–5, and as for the liquid crystal device, it is possible to use any of a TAFLC device having a voltage-transmittance characteristic as shown in FIG. 8, an OCB-mode liquid crystal device, a TN-mode liquid crystal device, and a DHF-mode liquid crystal device similarly as in the first embodiment.

Further, this embodiment of the liquid crystal display apparatus may be driven in similar manners according to either one of the two modes described with references to FIGS. 6 and 7 with respect to the first embodiment except that, in this embodiment, the first period Fa is set corresponding to the attenuation time $\tau_{off}$ of the liquid crystal in the mode of FIG. 6 and the attenuation time $\tau_{off}$ of the backlight in the mode of FIG. 7.

Next, some examples are set forth fist with respect to the first embodiment.

EXAMPLE 1

Three liquid crystal devices each having a pixel arrangement as shown in FIG. 2 and a sectional structure of pixel as shown in FIG. 3 were prepared through a conventional TFT-liquid crystal device production process. Each device comprised 160×120 pixels each having a planar size of 300 $\mu$m×300 $\mu$m. Each pixel was provided with an a-SiTFT having an on-resistance of ca. 1 M-ohm lower than the conventional level so as to provide a shorter selection period. The respective liquid crystal devices were constituted as a TATFLC-device, an OCB-mode nematic liquid crystal device using a nematic liquid crystal in a bend alignment, and a TN-mode liquid crystal device using a nematic liquid crystal in a twist-alignment.

Figure 9:
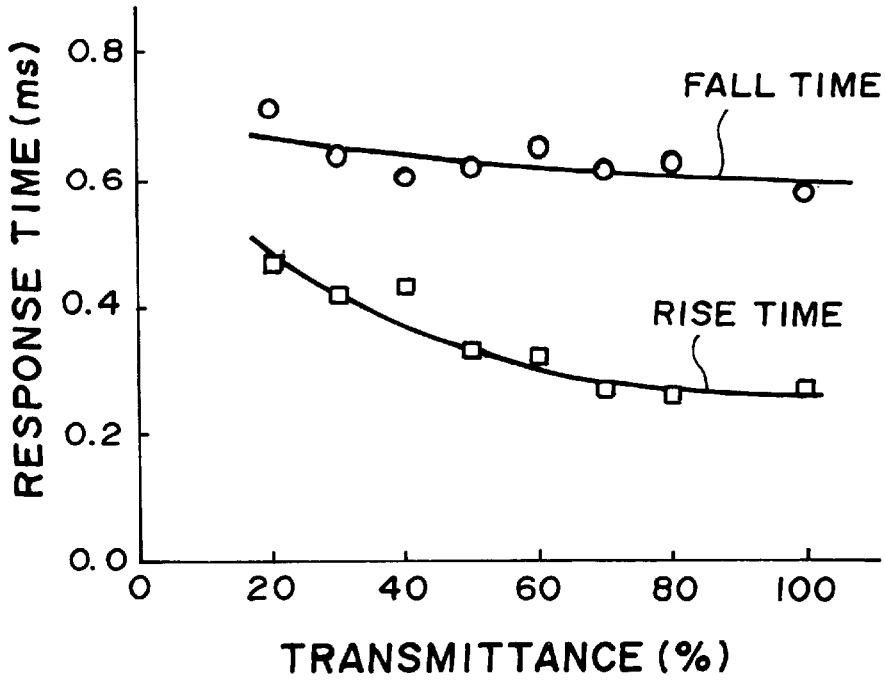
FIG. 9 shows applied voltage-dependent responsiveness of an anti-ferroelectric liquid crystal used in Examples of the invention.

More specifically, the liquid crystal used in the TAFLC-device exhibited a spontaneous polarization of 150 nC/cm$^2$ at 30° C., a tilt angle of 30 deg. from the rubbing direction and a dielectric constant of 5 and also exhibited a voltage-transmittance characteristic curve as shown in FIG. 8. The liquid crystal showed different response time at different applied voltages as shown in FIG. 9. In FIG. 9, the maximum transmittance and the minimum transmittance are normalized at 100% and 0%, respectively. The RISE TIME curve shows plots of response time required for a change of from 0% to 90% of an objective transmittance (%) indicated on the abscissa and the FALL TIME curve shows plots of response time required for a change of from a starting transmittance indicated on the absicssa to 10%-transmittance in the course of attenuation to 0%-transmittance. The response time measurement was performed at 25° C. As shown in FIG. 9, TAFLC showed a response time of below 1 msec.

In the OCB-mode device, a nematic liquid crystal ("KN5027xx", made by Chisso K.K.) was used and formed in a thickness (cell gap) of 4 $\mu$m. This liquid crystal also showed different response time at different voltages as show in FIG. 10A (in a normally black mode, at 25° C.) under definitions similar to those explained with respect to FIG. 9.

Figure 10A:
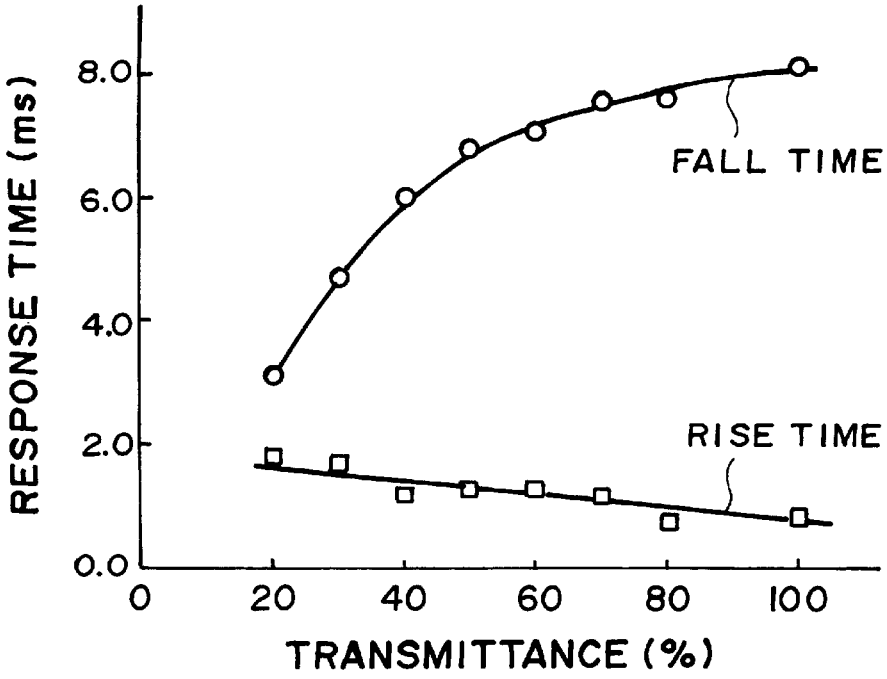
FIGS. 10A and 10B show applied voltage-dependent responsiveness of an OCB-mode nematic liquid crystal in a normally black-mode display and a normally white-mode display, respectively.
Figure 10B:
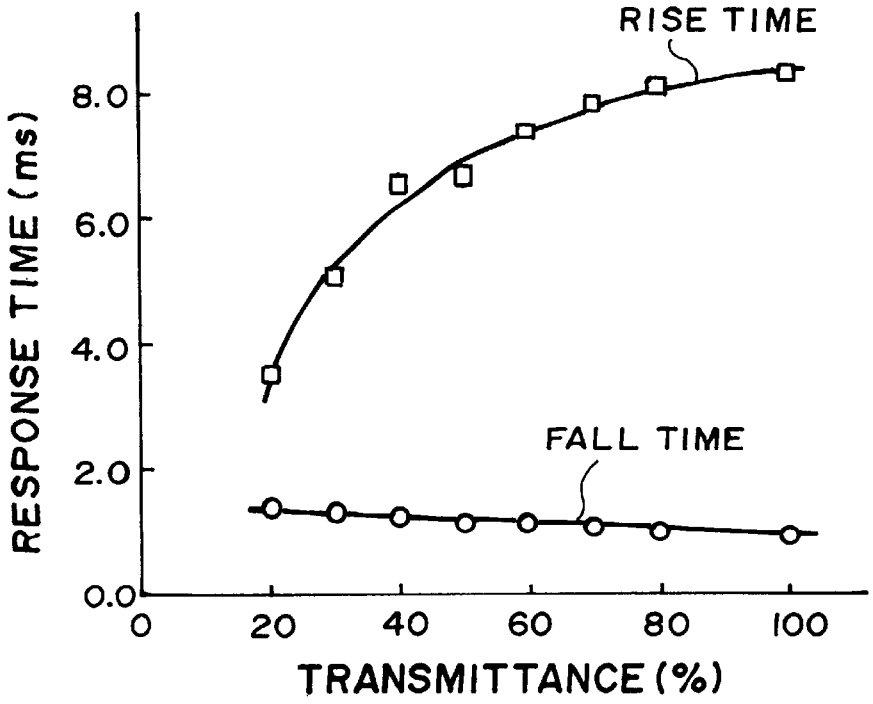

Further, FIG. 10B shows a response time characteristic obtained under similar definition by using the OCB-mode device (in a normally white mode). As shown in FIG. 10B, the relationship between the rise time and the fall time in the normally white mode is reverse to that in the normally black mode (as shown in FIG. 10A). Accordingly, a normally white ode display provides $\tau_{off}$ shorter than $\tau_{on}$ so that a better motion picture quality is attained.

Figure 11:
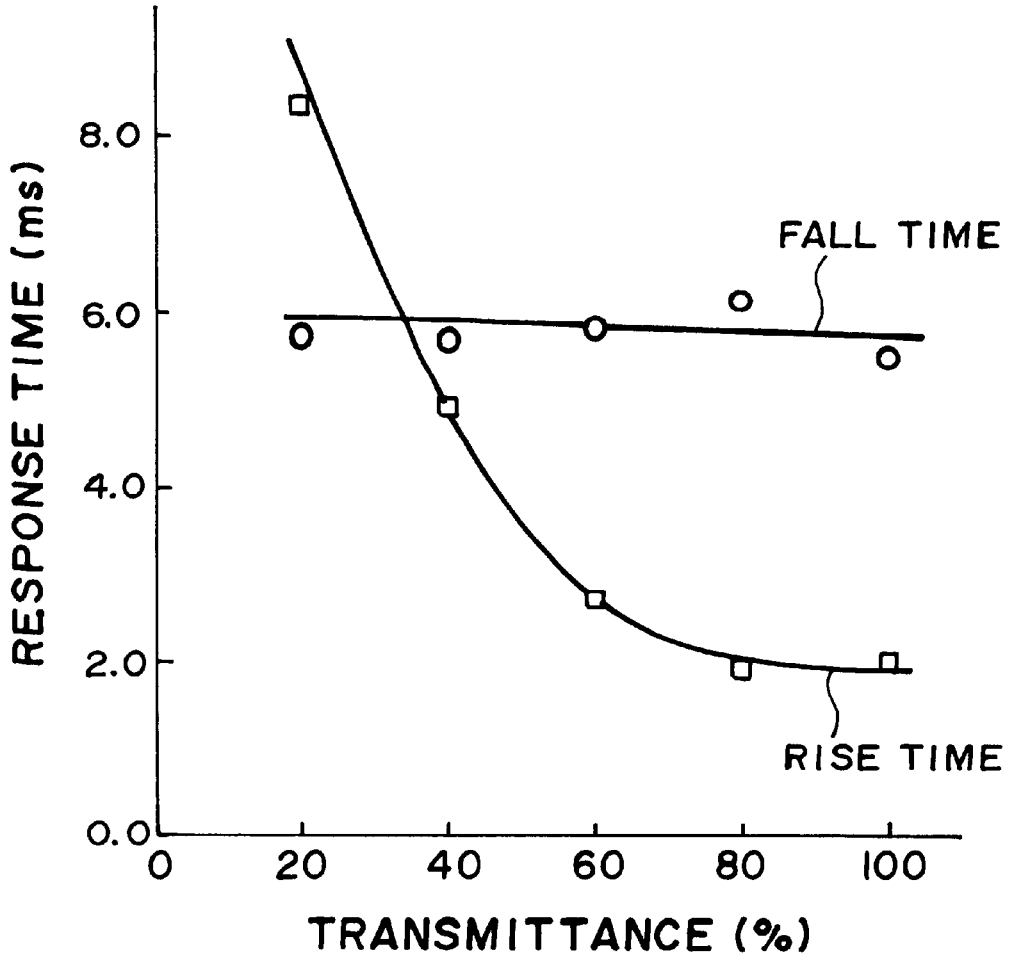
FIG. 11 shows an applied voltage-dependent responsiveness of a TN-mode nematic liquid crystal.

In the TN-mode liquid crystal device, a nematic liquid crystal "KN5015", made by Chisso K. K.) was used and formed in a thickness (cell gap) of 4.5 $\mu$m. This liquid crystal also showed different response time at different voltages as shown in FIG. 11 (in a normally black mode at 25° C.) under definitions similar to those explained with reference to FIG. 9.

The thus-prepared three types of liquid crystal devices were driven for motion picture display by utilizing a difference in response time (rise time $\tau_{on}$ and fall time $\tau_{off}$) to set substantially different conditions of $\tau_{off}$–$\tau_{on}$ in binary picture display while varying time aperture rate Tap, whereby motion picture quality was evaluated subjectively under the respective conditions. For the evaluation, the transmittance through the liquid crystal device and the luminance of the backlight source were adjusted so as to provide equal maximum luminance and minimum luminance under the respective conditions.

For the drive, the waveforms shown in FIG. 6 were used for line sequential selection of scanning lines, and in synchronism with each selection of a scanning line, prescribed data signals were applied under the conditions of Vc=0 volt, Vg=36 volts, and for, e.g., TAFLC, Vcs=10 volts, $V_{s1}$=16 volts and $V_{s2}$=4 volts. For other liquid crystals, data signals of appropriately adjusted voltage values were applied along the same time chart. In all the cases, one frame period was set to 16.8 ms, and other periods were set to, e.g., Fa=8.4 ms, Fb=8.4 ms, and T1=T2=70 $\mu$s. Tap was increased or decreased by using a shorter or longer T1.

The evaluation of motion picture quality was performed by observation with eyes under the conditions of a picture display speed of averagely ca. 12 deg/s, a display luminance of 150 cd/m$^2$, a contrast of 100:1 and a distance of 30 cm from the viewer to the panel (display device). The results are summarized in FIG. 12, wherein O represents that deterioration was not noticeable, Δ represents that some deterioration was noticeable but at a level of providing an acceptable display, and X represents that deterioration was noticeable to a level of providing non-acceptable display.

Figure 12:
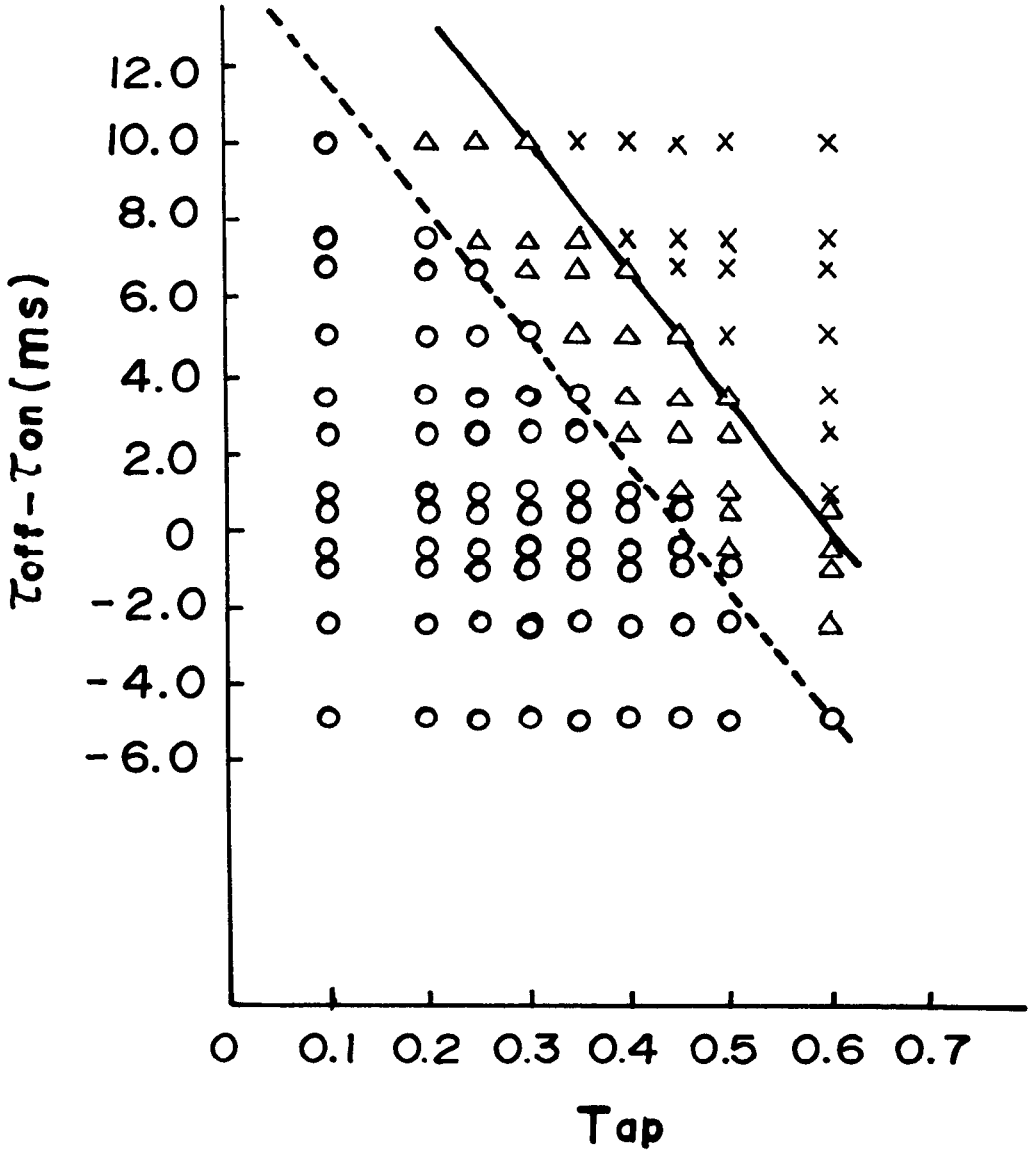
FIG. 12 shows plots of subjective evaluation results of a motion picture quality under various combinations of $\tau_{off}$–$\tau_{on}$ and Tap.

In FIG. 12, a solid line represents Tap+($\tau_{off}$–$\tau_{on}$)/2Fr=Ts=0.6, and a dashed line represents Ts=0.45. As shown in FIG. 12, a substantial improvement in motion picture quality was observed if Ts≦0.6, and particularly the motion picture quality was improved to a level that substantially no deterioration was recognized if Ts≦0.45.

EXAMPLE 2

The TAFLC device prepared in Example 1 was used in combination with a backlight source having a lighting circuit shown in FIG. 5. The backlight source included R-LED of CaAlAs driven at ca. 14 volts, and G- and B-LEDs of GaN driven at ca. 25 volts, with a current of 20 mA at the maximum for each LED.

The display apparatus was driven by using waveform shown in FIG. 7 set to Vc=0 volt, Vg=36 volts, Vcs=10 volts, $V_{s1}$=16 volts, $V_{s2}$=4 volts and 1 frame period of 16.8 ms including other periods set to, e.g., Fa=4.8 ms, Fb=12 ms, T1=40 $\mu$s, and T3=1 ms. Tap was increased or decreased by using longer T1 and T3 or shorter T1 and T3, respectively. Further, the response time $\tau_{on}$ and $\tau_{off}$ of the backlight were adjusted by controlling the lighting circuit to set different conditions of Tap and $\tau_{off}$–$\tau_{on}$ in binary picture display, whereby motion picture quality was evaluated with eyes under the respective conditions. For the evaluation, the transmittance through the liquid crystal panel and the luminance of the backlight were adjusted so as to provide equal maximum and minimum luminances under the respective conditions. Combinations of Tap and $\tau_{off}$–$\tau_{on}$ were set similarly as in Example 1.

The evaluation of motion picture quality was performed by subjective observation with eyes under the conditions of a picture display speed of ca. 12 deg/s, a display luminance of 150 cd/m$^2$, a contrast of 100:1, and a distance of 30 cm from the viewer to the display panel.

As a result, identical evaluation results were obtained as in Example 1 for identical values of $\tau_{off}$–$\tau_{on}$ and Tap, so that improvement in motion picture quality was recognized if Ts≦0.6, and particularly if Ts≦0.45, the motion picture quality was improved to a level that substantially no deterioration was noticeable.

EXAMPLE 3

Liquid crystal devices having substantially identical structures as those in Example 1 but having 480×360 pixels each in a size of 100 $\mu$m-square were prepared, and driven under different combinations of Tap and $\tau_{off}$–$\tau_{on}$ in parallel with the devices of Example 1 so as to examine the influence of pixel size Sz on the motion picture quality.

A binary picture display was performed similarly as in Example 1. Further, the above two types of devices were also driven with pixel size enlargement. For example, the device with 300 μm-square pixels was driven by driving 2×2 pixels as one pixel of a substantially 600 μm-square. Motion picture data supply speed was made equal for all the pixel sizes. Accordingly, the display picture speed recognizable to a viewer was increased at a larger pixel size.

The picture display speed was changed in various manners with an average of 12 deg./sec for the pixel size of 300 μm-square. The liquid crystal display devices were driven under the conditions of a display luminance of 150 cd/m$^2$, a contrast of ca. 100:1, and a distance of 30 cm from the viewer to the panel.

Figure 13A:
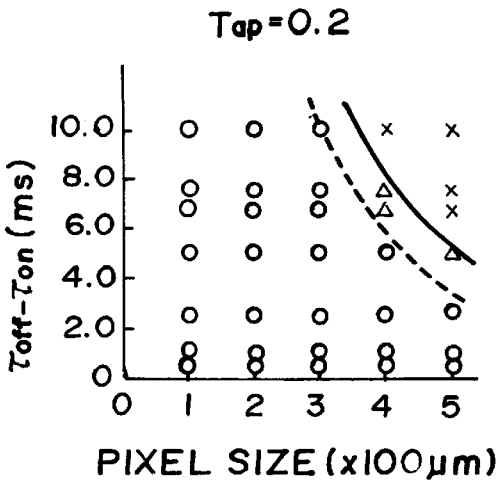
FIGS. 13A–13D show plots of subjective evaluation results of motion picture quality under various combinations of $\tau_{off}$–$\tau_{on}$ and pixel sizes at four levels of Tap in Example 3.
Figure 13B:
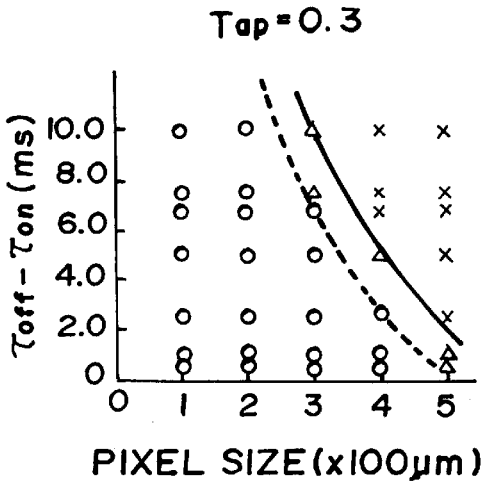
Figure 13C:
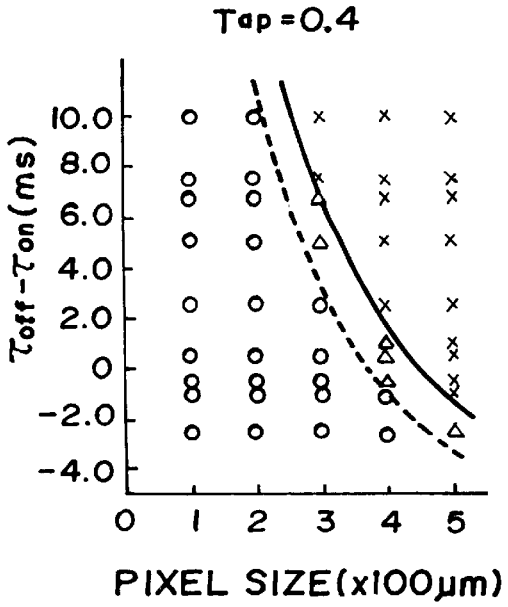
Figure 13D:
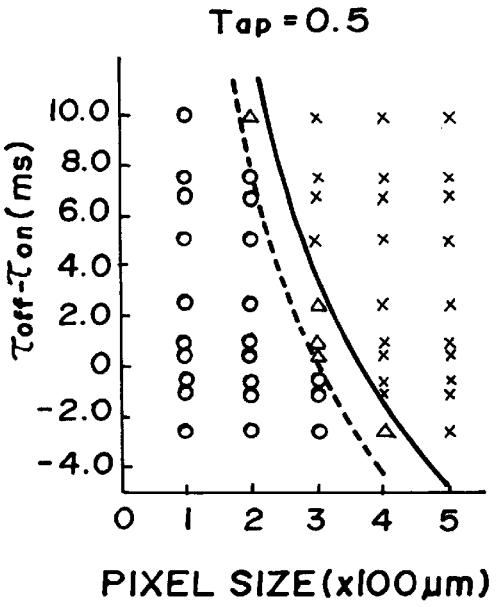

The results of subjective evaluation with eyes are inclusively shown in FIGS. 13A–13D. FIG. 13A shows the results with Tap=0.2; FIG. 13B, Tap=0.3, FIG. 13C, Tap=0.4; and FIG. 13D, Tap=0.5. In these figures, O represents with no noticeable deterioration; Δ, deterioration noticeable to some extent; and x, noticeable deterioration.

Solid lines in FIGS. 13A–13D represent $Ts\times Sz/(300\times10^{-6})=0.6$, and dashed lines represent $Ts\times Sz/(300\times10^{-6})=0.5$. As shown in these figures, an improved motion picture quality was attained if $Ts\times Sz/(300\times10^{-6})\leqq0.6$ and the motion picture quality was improved to a level of substantially no noticeable deterioration if $Ts\times Sz/(300\times10^{-6})\leqq0.5$.

EXAMPLE 4

Among the devices used in Example 3, TAFLC devices were used in combination with the backlight source used in Example 2.

A binary picture display was performed similarly as in Example 3. Display with different pixel sizes was performed by using two types of devices while employing pixel size-enlargement drive as used in Example 3. Motion picture data supply speed was made equal for all the pixel sizes. Accordingly, the display picture speed recognizable to a viewer was increased at a larger pixel size.

The picture display speed was changed in various manners with an average of 12 deg./sec for the pixel size of 300 μm-square. The liquid crystal display devices were driven under the conditions of a display luminance of 150 cd/m$^2$, a contrast of ca. 100:1, and a distance of 30 cm from the viewer to the panel.

As a result, identical evaluation results were obtained as in Example 3 for identical values of $\tau_{off}$–$\tau_{on}$ and Tap, so that an improved motion picture quality was attained if $Ts\times Sz/(300\times10^{-6})\leqq0.6$ and the motion picture quality was improved to a level of substantially no noticeable deterioration if $Ts\times Sz/(300\times10^{-6})\leqq0.5$.

EXAMPLE 5

Liquid crystal display apparatus prepared in Example 1 were driven while changing Tap and $\tau_{off}$–$\tau_{on}$ similarly as in Example 1 and further changing the luminance of the backlight and the transmittance of the liquid crystal to examine the influence of luminance Br (cd/m$^2$) on motion picture quality. Binary picture display was performed similarly as in Example 1.

The picture display speed was changed in various manners with an average of 12 deg./sec. The liquid crystal display devices were driven under the conditions of a contrast of ca. 100:1, and a distance of 30 cm from the viewer to the pawl.

Figure 14A:
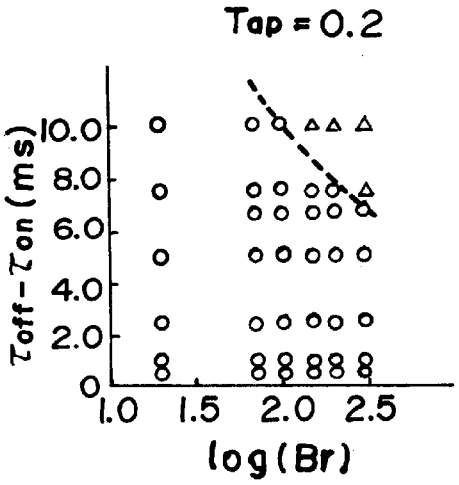
FIGS. 14A–14D show plots of subjective evaluation results of motion picture quality under various combinations of $\tau_{off}$–$\tau_{on}$ and luminance at four levels of Tap in Example 5.
Figure 14B:
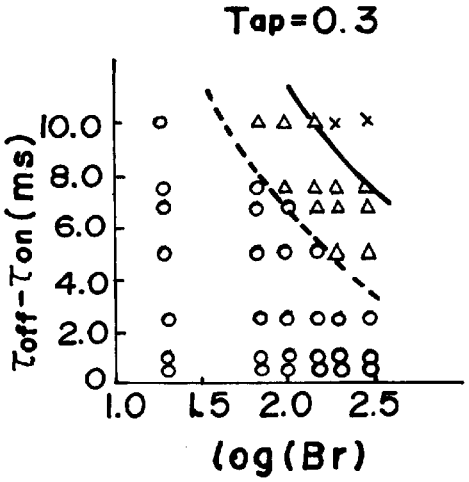
Figure 14C:
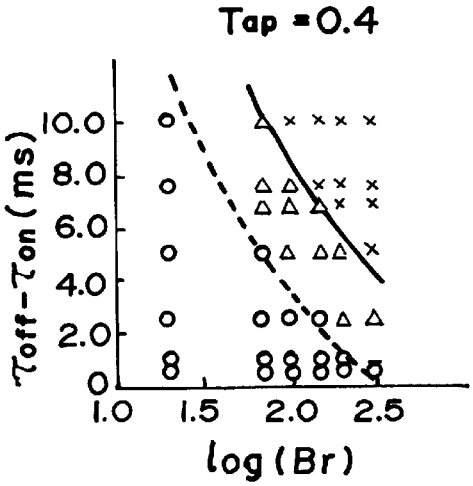
Figure 14D:
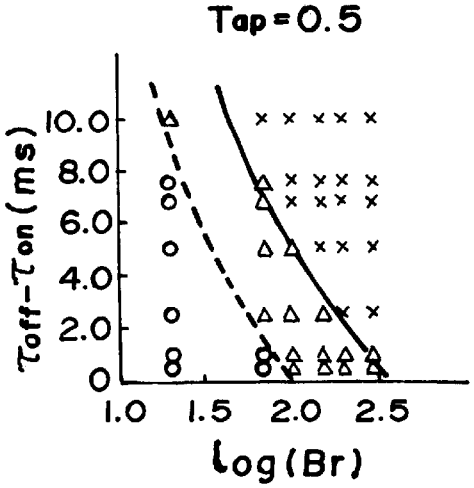

The results of subjective evaluation with eyes are inclusively shown in FIGS. 14A–14D. FIG. 14A shows the results with Tap=0.2; FIG. 14B, Tap=0.3, FIG. 14C, Tap=0.4; and FIG. 14D, Tap=0.5. In these figures, o represents with no noticeable deterioration; Δ, deterioration noticeable to some extent; and X, noticeable deterioration.

Solid lines in FIGS. 14A–14D represent $Ts\times\log(Br)=1.3$, and dashed lines represent $Ts\times\log(Br)=1.0$. As shown in these figures, an improved motion picture quality was attained if $Ts\times\log(Br)\leqq1.3$ and the motion picture quality was improved to a level of substantially no noticeable deterioration if $Ts\times\log(Br)\leqq1.0$.

EXAMPLE 6

Liquid crystal display apparatus prepared in Example 2 were driven while changing Tap and $\tau_{off}$–$\tau_{on}$ similarly as in Example 2 and further changing the luminance of the backlight and the transmittance of the liquid crystal to examine the influence of luminance Br (cd/m$^2$) on motion picture quality. Binary picture display was performed similarly as in Example 2.

The picture display speed was changed in various manners with an average of 12 deg./sec. The liquid crystal display devices were driven under the conditions of a contrast of ca. 100:1, and a distance of 30 cm from the viewer to the panel.

As a result, identical evaluation results were obtained as in Example 5 for identical values of $\tau_{off}$–$\tau_{on}$ and Tap, so that an improved motion picture quality was attained if $Ts\times\log(Br)\leqq1.3$ and the motion picture quality was improved to a level of substantially no noticeable deterioration if $Ts\times\log(Br)\leqq1.0$.

EXAMPLE 7

Liquid crystal display apparatus prepared in Example 1 were driven while changing Tap and $\tau_{off}$–$\tau_{on}$ similarly as in Example 1 and further changing the luminance of the backlight, the transmittance of the liquid crystal and polarizer-positions to examine the influence of contrast Cr on motion picture quality. Binary picture display was performed similarly as in Example 1.

The picture display speed was changed in various manners with an average of 12 deg./sec. The liquid crystal display devices were driven under the conditions of a display luminance of 150 cd/m$^2$, and a distance of 30 cm from the viewer to the panel.

Figure 15A:
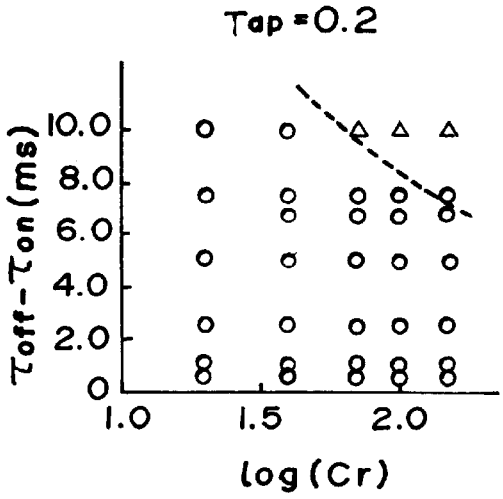
FIGS. 15A–15D show plots of subjective evaluation results of motion picture quality under various combinations of $\tau_{off}$–$\tau_{on}$ and contrast at four levels of Tap in Example 7.
Figure 15B:
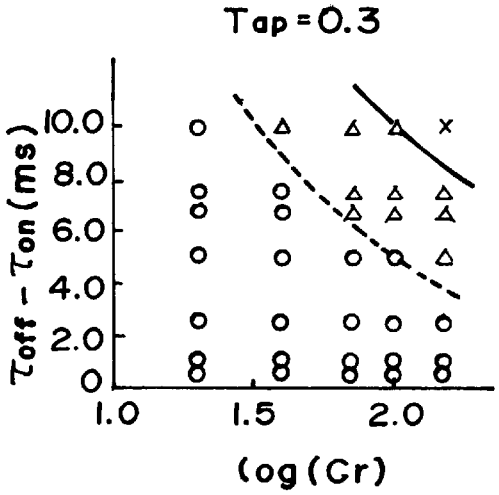
Figure 15C:
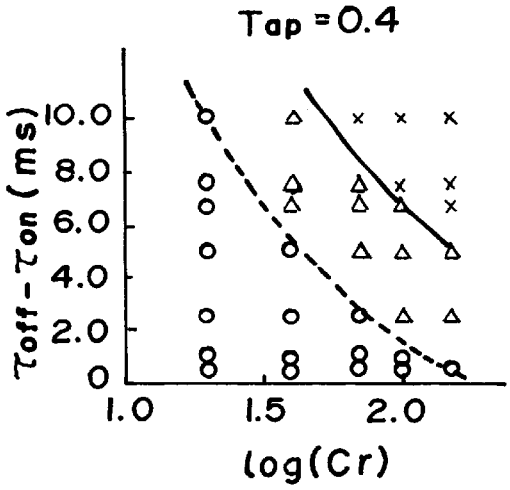
Figure 15D:
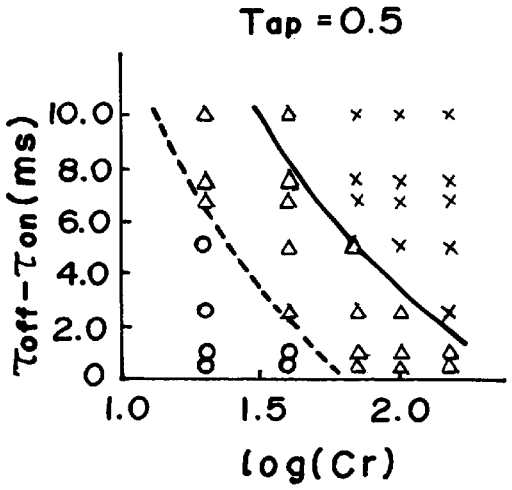

The results of subjective evaluation with eyes are inclusively shown in FIGS. 15A–15D. FIG. 15A shows the results with Tap=0.2; FIG. 15B, Tap=0.3, FIG. 15C, Tap=0.4; and FIG. 15D, Tap=0.5. In these figures, O represents with no noticeable deterioration; Δ, deterioration noticeable to some extent; and x, noticeable deterioration.

Solid lines in FIGS. 15A–15D represent $Ts\times\log(Cr)=1.2$, and dashed lines represent $Ts\times\log(Cr)=0.9$. As shown in these figures, an improved motion picture quality was attained if $Ts\times\log(Cr)\leqq1.2$ and the motion picture quality was improved to a level of substantially no noticeable deterioration if $Ts\times\log(Cr)\leqq0.9$.

EXAMPLE 8

Liquid crystal display apparatus prepared in Example 2 were driven while changing Tap and $\tau_{off}$–$\tau_{on}$ similarly as in Example 2 and further changing the luminance of the backlight and the transmittance of the liquid crystal to examine the influence of contrast Cr on motion picture quality. Binary picture display was performed similarly as in Example 2.

The picture display speed was changed in various manners with an average of 12 deg./sec. The liquid crystal display devices were driven under the conditions of a display luminance of 150 cd/m$^2$, and a distance of 30 cm from the viewer to the panel.

As a result, identical evaluation results were obtained as in Example 7 for identical values of $\tau_{off}-\tau_{on}$ and Tap, so that an improved motion picture quality was attained if Ts×log (Cr)≦1.2 and the motion picture quality was improved to a level of substantially no noticeable deterioration if Ts×log (Cr)≦0.9.

Next, some examples according to the second embodiment are set forth below.

EXAMPLE 9

Three liquid crystal devices each having a pixel arrangement as shown in FIG. 2 and a sectional structure of pixel as shown in FIG. 3 were prepared through a conventional TFT-liquid crystal device production process. Each device comprised 160×120 pixels each having a planar size of 300 μm×300 μm. Each pixel was provided with an a-SiTFT having an on-resistance of ca. 1 M-ohm so as to provide a shorter selection period. The respective liquid crystal devices were constituted as a TATFLC-device and two OCB-mode nematic liquid crystal devices each using a nematic liquid crystal in a bend alignment.

Figure 17:
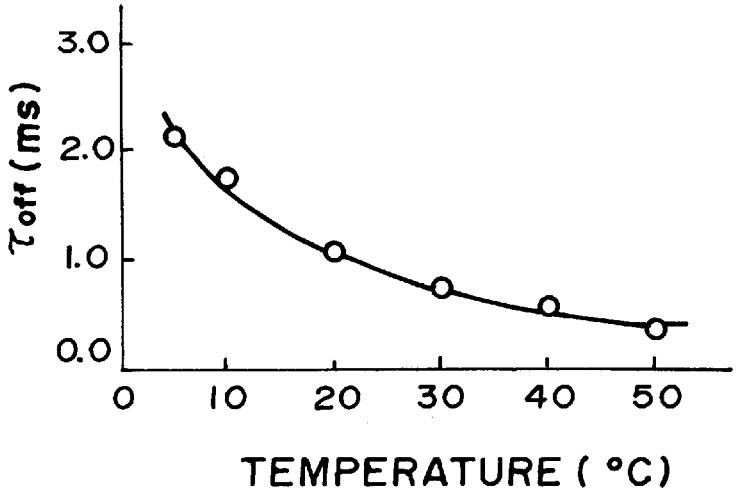
FIG. 17 shows temperature-dependent responsiveness of an anti-ferroelectric liquid crystal used in Examples of the invention.

More specifically, the liquid crystal used in the TAFLC-device exhibited a spontaneous polarization of 150 nC/cm$^2$ at 30° C., a tilt angle of 30 deg. from the rubbing direction and a dielectric constant of 5 and also exhibited a voltage-transmittance characteristic curve as shown in FIG. 8. The liquid crystal showed different response time at different temperatures as shown in FIG. 17. The curve of FIG. 17 shows plots of temperature-dependent response time $\tau_{off}$ required for a change of transmittance of from 100% to 10% when the maximum transmittance was normalized at 100% and the minimum transmittance was normalized at 0%.

Figure 18:
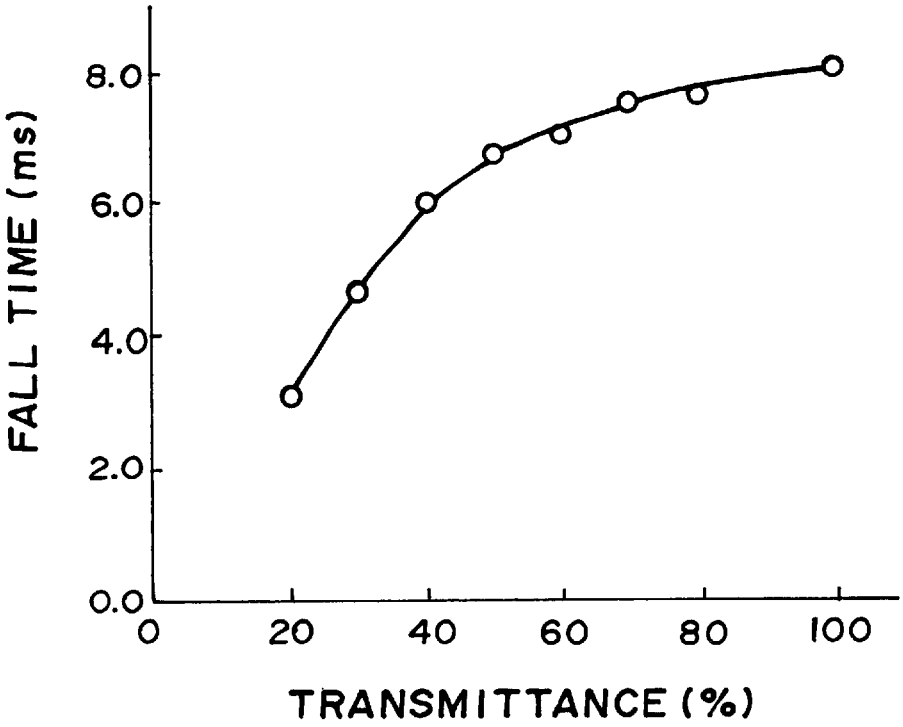
FIGS. 18 and 19 respectively show an applied voltage-dependent responsiveness of an OCB-mode nematic liquid crystal used in Examples.
Figure 19:
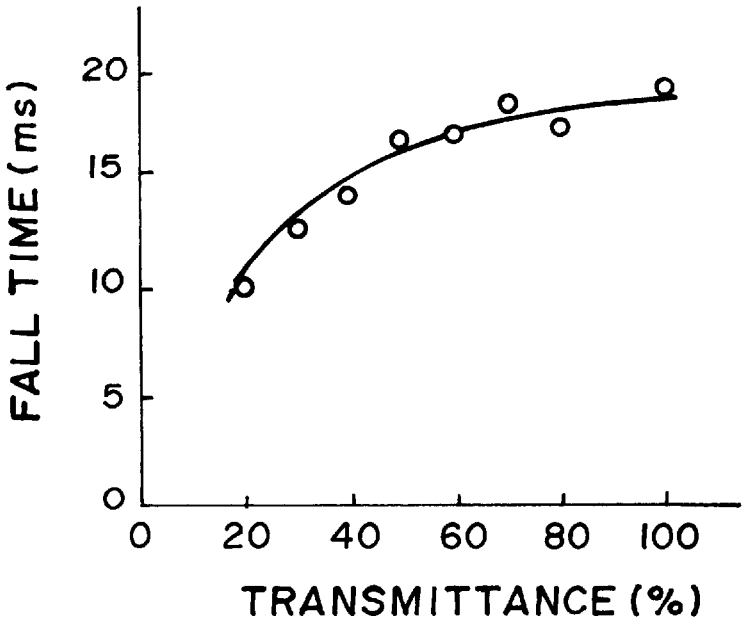

In the OCB-mode devices, two nematic liquid crystals ("KN5027xx" and "KN5030", both made by Chisso K.K.) were used. These liquid crystals respectively showed different response time (fall time) at different applied voltages as shown in FIG. 18 ("KN5027xx) and FIG. 19 ("KN5030"), respectively. In FIGS. 18 and 19, the maximum transmittance and minimum transmittance are normalized at 100% and 0%, respectively. FIGS. 18 and 19 respectively show plots of response time (fall time) required for a starting transmittance indicated on the abscissa to 10%-transmittance in the course of attenuation from the starting transmittance to 0%-transmittance. The response time measurement was performed at 25° C. in a normally black display mode.

The thus-prepared three types of liquid crystal devices were driven for motion picture display by utilizing a difference in $\tau_{off}$ dependent on temperature of TAFLC and gradation characteristic of OCB shown in FIGS. 17–19 to set substantially different conditions of $\tau_{off}$ in binary picture display while varying time aperture rate Tap, whereby motion picture quality was evaluated subjectively under the respective conditions. For the evaluation, the transmittance through the liquid crystal device and the luminance of the backlight source were adjusted so as to provide equal maximum luminance and minimum luminance under the respective conditions.

For the drive, the waveforms shown in FIG. 6 were used for line sequential selection of scanning lines, and in synchronism with each selection of a scanning line, prescribed data signals were applied under the conditions of Vc=0 volt, Vg=36 volt, and for, e.g., TAFLC, Vcs=10 volts, $V_{s1}$=16 volts and $V_{s2}$=4 volts. For other liquid crystals, data signals of appropriately adjusted voltage values were applied along the same time chart. In all the cases, one frame period was set to 16.8 ms including other perods set to, e.g., Fa=8.4 ms, Fb=8.4 ms, and T1=T2=70 μs. Tap was increased or decreased by using a shorter or longer T1.

The evaluation of motion picture quality was performed by observation with eyes under the conditions of a picture display speed of averagely ca. 12 deg/s, a display luminance of 150 cd/m$^2$, a contrast of 100:1 and a distance of 30 cm from the viewer to the panel (display device). The results are summarized in FIG. 20, wherein O represents that deterioration was not noticeable, Δ represents that some deterioration was noticeable but at a level of providing an acceptable display, and X represents that deterioration was noticeable to a level of providing non-acceptable display.

Figure 20:
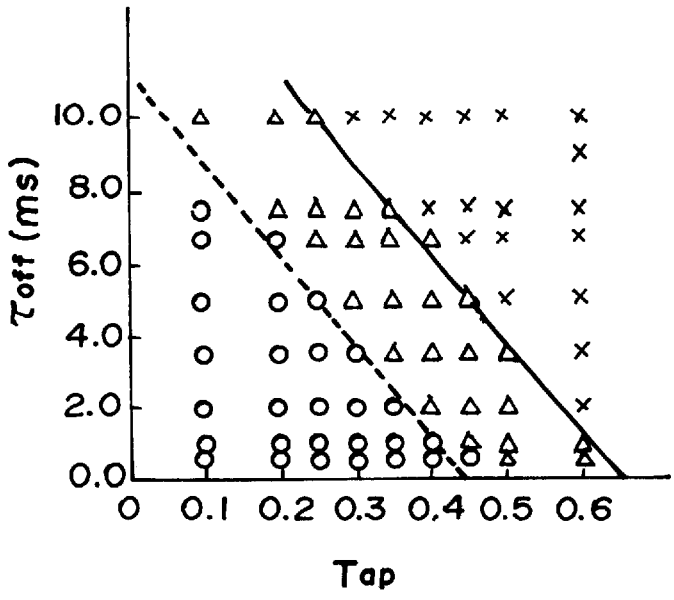
FIG. 20 shows plots of subjective evaluation results of a motion picture quality under various combinations of $\tau_{off}$ and Tap.

In FIG. 20, a solid line represents Tap+($\tau_{off}$/1.5Fr=Ts=0.65, and a dashed line represents Ts=0.45. As shown in FIG. 20, a substantial improvement in motion picture quality was observed if Ts≦0.65, and particularly the motion picture quality was improved to a level that substantially no deterioration was recognized if Ts≦0.45.

EXAMPLE 10

The TAFLC device prepared in Example 9 was used in combination with a backlight source having a lighting circuit shown in FIG. 5. The backlight source included R-LED of CaAlAs driven at ca. 14 volts, and G- and B-LEDs of GaN driven at ca. 25 volts, with a current of 20 mA at the maximum for each LED.

Figure 21:
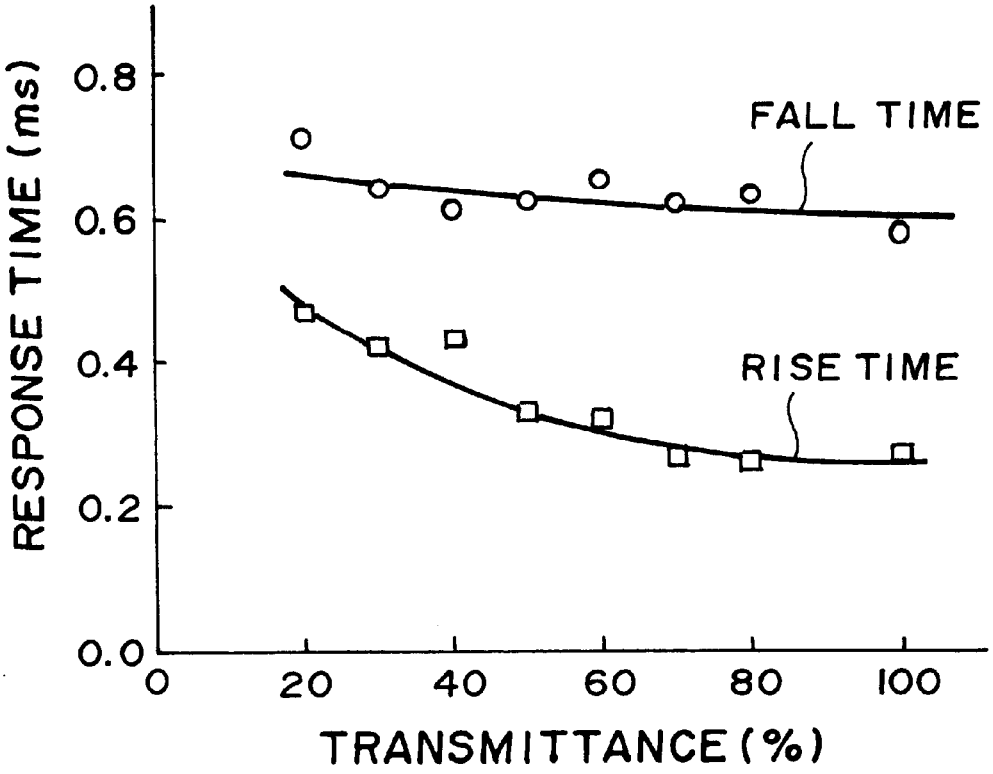
FIG. 21 shows applied voltage-depending responsiveness of an anti-ferroelectric liquid crystal used in Examples.

The liquid crystal used in the TAFLC-device of this Example (and also of Example 9) showed different response time at different applied voltages as shown in FIG. 21. In FIG. 21, the maximum transmittance and the minimum transmittance are normalized at 100% and 0%, respectively. The RISE TIME curve shows plots of response time required for a change of from 0% to 90% of an objective transmittance (%) indicated on the abscissa and the FALL TIME curve shows plots of response time required for a change of from a starting transmittance indicated on the absicssa to 10%-transmittance in the course of attenuation to 0%-transmittance. The response time measurement was performed at 25° C. As shown in FIG. 21, TAFLC showed a response time of below 1 msec.

The display apparatus was driven by using waveform shown in FIG. 7 set to Vc=0 volt, Vg=36 volts, Vcs=10 volts, $V_{s1}$=16 volts, $V_{s2}$=4 volts and 1 frame period of 16.8 ms including other periods set to, e.g., Fa=4.8 ms, Fb=12 ms, T1=40 μs, and T3=1 ms. Tap was increased or decreased by using longer T1 and T3 or shorter T1 and T3, respectively. Further, the response time $\tau_{off}$ of the backlight was adjusted by controlling the lighting circuit to set different conditions of Tap and $\tau_{off}$ in binary picture display, whereby motion picture quality was evaluated with eyes under the respective conditions. For the evaluation, the transmittance through the liquid crystal panel and the luminance of the backlight were adjusted so as to provide equal maximum and minimum luminances under the respective conditions. Combinations of Tap and $\tau_{off}$ was set similarly as in Example 9.

The evaluation of motion picture quality was performed by subjective observation with eyes under the conditions of a picture display speed of ca. 12 deg/s, a display luminance of 150 cd/m$^2$, a contrast of 100:1, and a distance of 30 cm from the viewer to the display panel.

As a result, identical evaluation results were obtained as in Example 9 for identical values of $\tau_{off}$ and Tap, so that improvement in motion picture quality was recognized if Ts≦0.65, and particularly if Ts≦0.45, the motion picture quality was improved to a level that substantially no deterioration was noticeable.

EXAMPLE 11

Liquid crystal devices having substantially identical structures as those in Example 9 but having 480×360 pixels each in a size of 100 μm-square were prepared, and driven under different combinations of Tap and $\tau_{off}$ in parallel with the devices of Example 9 so as to examine the influence of pixel size Sz on the motion picture quality.

A binary picture display was performed similarly as in Example 9. Further, the above two types of devices were also driven with pixel size enlargement. For example, the device with 300 μm-square pixels was driven by driving 2×2 pixels as one pixel of a substantially 600 μm-square. Motion picture data supply speed was made equal for all the pixel sizes. Accordingly, the display picture speed recognizable to a viewer was increased at a larger pixel size.

The picture display speed was changed in various manners with an average of 12 deg./sec for the pixel size of 300 μm-square. The liquid crystal display devices were driven under the conditions of a display luminance of 150 cd/m$^2$, a contrast of ca. 100:1, and a distance of 30 cm from the viewer to the panel.

Figure 22A:
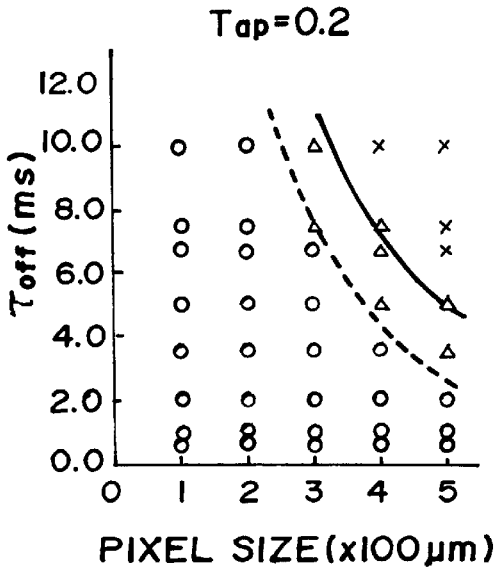
FIGS. 22A–22D show plots of subjective evaluation results of motion picture quality under various combinations of doff and pixel sizes at four levels of Tap in Example 11.
Figure 22B:
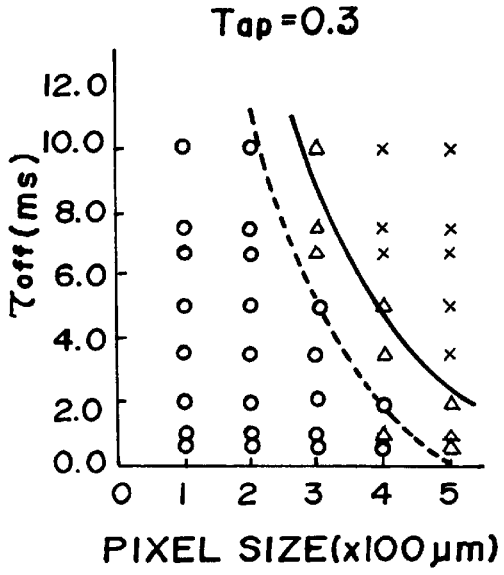
Figure 22C:
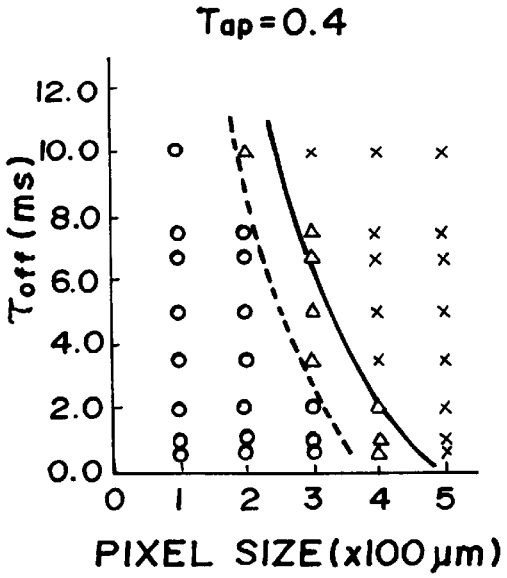
Figure 22D:
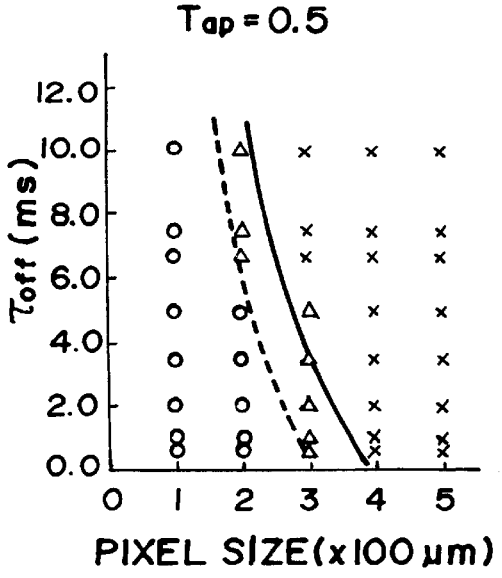

The results of subjective evaluation with eyes are inclusively shown in FIGS. 22A–22D. FIG. 22A shows the results with Tap=0.2; FIG. 22B, Tap=0.3, FIG. 22C, Tap=0.4; and FIG. 22D, Tap=0.5. In these figures; O represents with no noticeable deterioration; Δ, deterioration noticeable to some extent; and x, noticeable deterioration.

Solid lines in FIGS. 22A–22D represent Ts×Sz/(300×10$^{-6}$)=0.65, and dashed lines represent Ts×Sz/(300×10$^{-6}$)=0.5. As shown in these figures, an improved motion picture quality was attained if Ts×Sz/(300×10$^{-6}$)≦0.6 and the motion picture quality was improved to a level of substantially no noticeable deterioration if Ts×Sz/(300×10$^{-6}$)≦0.5.

EXAMPLE 12

Among the devices used in Example 11, TAFLC devices were used in combination with the backlight source used in Example 10.

A binary picture display was performed similarly as in Example 11. Display with different pixel sizes was performed by using two types of devices while employing pixel size-enlargement drive as used in Example 11. Motion picture data supply speed was made equal for all the pixel sizes. Accordingly, the display picture speed recognizable to a viewer was increased at a larger pixel size.

The picture display speed was changed in various manners with an average of 12 deg./sec for the pixel size of 300 μm-square. The liquid crystal display devices were driven under the conditions of a display luminance of 150 cd/m$^2$, a contrast of ca. 100:1, and a distance of 30 cm from the viewer to the panel.

As a result, identical evaluation results were obtained as in Example 11 for identical values of $\tau_{off}$ and Tap, so that an improved motion picture quality was attained if Ts×Sz/(300×10$^{-6}$)≦0.65 and the motion picture quality was improved to a level of substantially no noticeable deterioration if Ts×Sz/(300×10$^{-6}$)≦0.5.

EXAMPLE 13

Liquid crystal display apparatus prepared in Example 1 were driven while changing Tap and $\tau_{off}$ similarly as in Example 9 and further changing the luminance of the backlight and the transmittance of the liquid crystal to examine the influence of luminance Br (cd/$^2$) on motion picture quality. Binary picture display was performed similarly as in Example 9.

The picture display speed was changed in various manners with an average of 12 deg./sec. The liquid crystal display devices were driven under the conditions of a contrast of ca. 100:1, and a distance of 30 cm from the viewer to the panel.

Figure 23A:
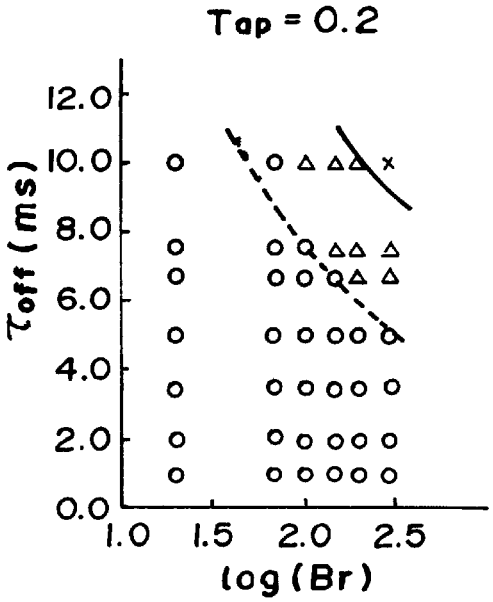
FIGS. 23A–23D show plots of subjective evaluation results of motion picture quality under various combinations of doff and luminance at four levels of Tap in Example 13.
Figure 23B:
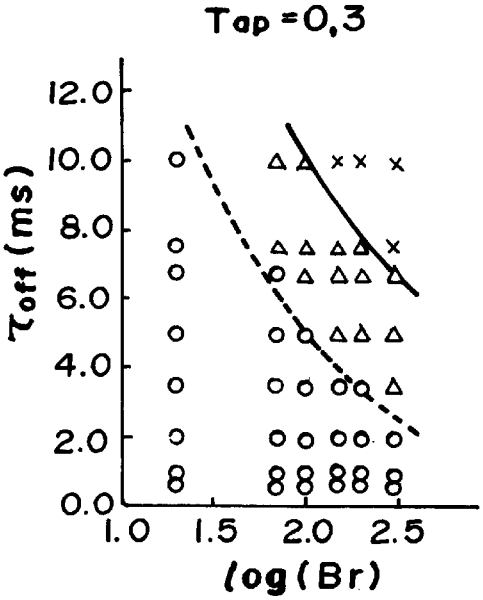
Figure 23C:
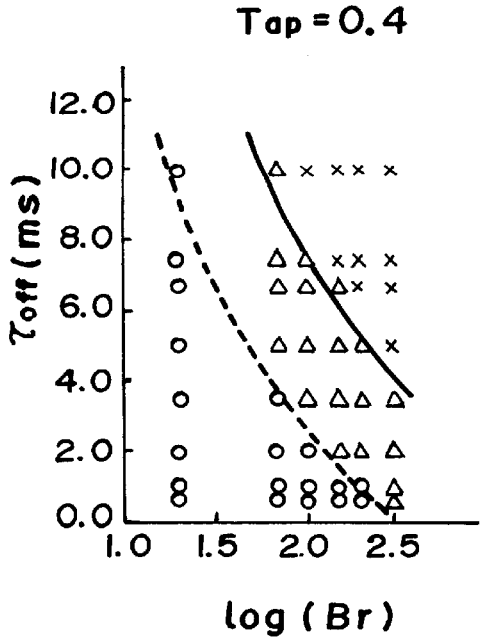
Figure 23D:
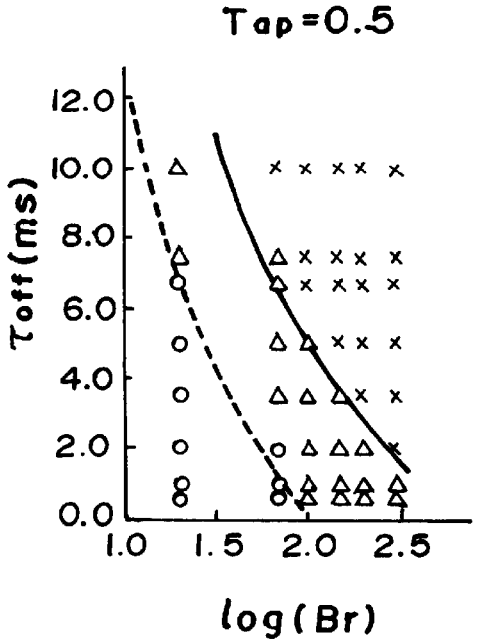

The results of subjective evaluation with eyes are inclusively shown in FIGS. 23A–23D. FIG. 23A shows the results with Tap=0.2; FIG. 23B, Tap=0.3, FIG. 23C, Tap=0.4; and FIG. 23D, Tap=0.5. In these figures; O represents with no noticeable deterioration; Δ, deterioration noticeable to some extent; and x, noticeable deterioration.

Solid lines in FIGS. 23A–23D represent Ts×log(Br)=1.4, and dashed lines represent Ts×log(Br)=1.0. As shown in these figures, an improved motion picture quality was attained if Ts×log(Br)≦1.4 and the motion picture quality was improved to a level of substantially no noticeable deterioration if Ts×log(Br)≦1.0.

EXAMPLE 14

Liquid crystal display apparatus prepared in Example 10 were driven while changing Tap and $\tau_{off}$ similarly as in Example 10 and further changing the luminance of the backlight and the transmittance of the liquid crystal to examine the influence of luminance Br (cd/m$^2$) on motion picture quality. Binary picture display was performed similarly as in Example 10.

The picture display speed was changed in various manners with an average of 12 deg./sec. The liquid crystal display devices were driven under the conditions of a contrast of ca. 100:1, and a distance of 30 cm from the viewer to the panel.

As a result, identical evaluation results were obtained as in Example 13 for identical values of $\tau_{off}$ and Tap, so that an improved motion picture quality was attained if Ts×log(Br)≦1.4 and the motion picture quality was improved to a level of substantially no noticeable deterioration if Ts×log(Br)≦1.0.

EXAMPLE 15

Liquid crystal display apparatus prepared in Example 9 were driven while changing Tap and $\tau_{off}$ similarly as in Example 9 and further changing the luminance of the backlight, the transmittance of the liquid crystal and polarizer positions to examine the influence of contrast Cr on motion picture quality. Binary picture display was performed similarly as in Example 9.

The picture display speed was changed in various manners with an average of 12 deg./sec. The liquid crystal display devices were driven under the conditions of a display luminance of 150 cd/m$^2$, and a distance of 30 cm from the viewer to the panel.

Figure 24A:
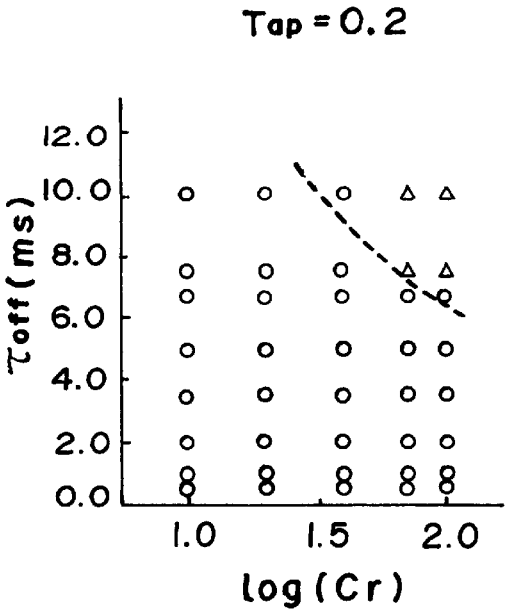
FIGS. 24A–24D show plots of subjective evaluation results of motion picture quality under various combinations of $\tau_{off}$ and contrast at four levels of Tap in Example 15.
Figure 24B:
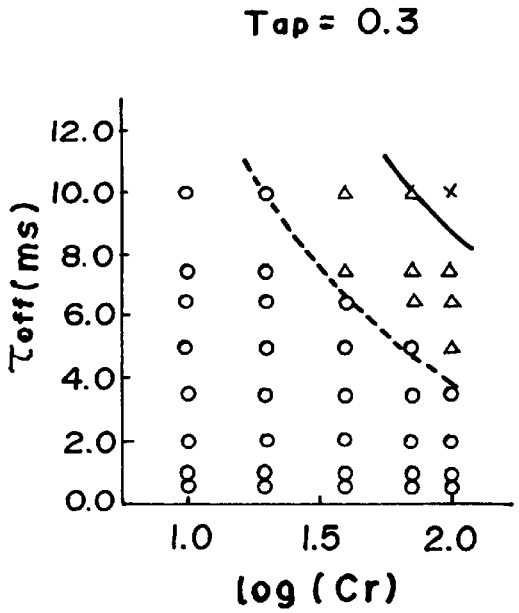
Figure 24C:
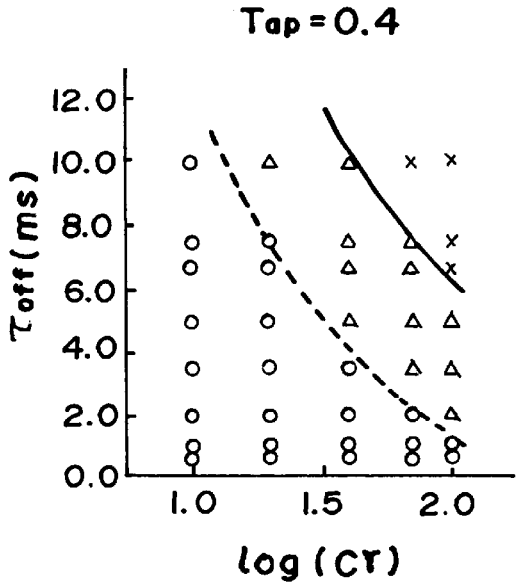

The results of subjective evaluation with eyes are inclusively shown in FIGS. 24A–24D. FIG. 24A shows the results with Tap=0.2; FIG. 24B, Tap=0.3, FIG. 24C, Tap=

Figure 24D:
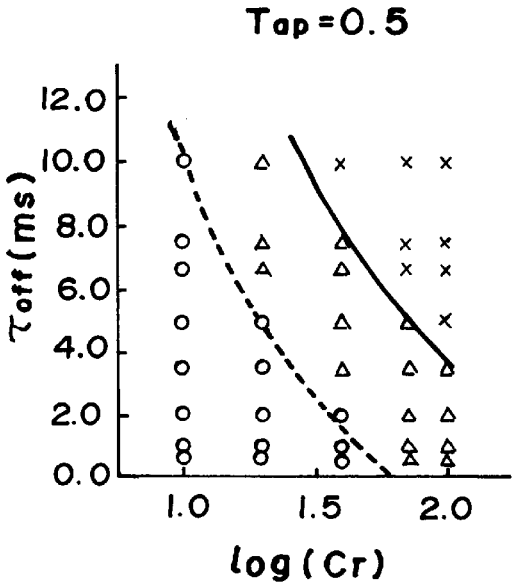

0.4; and FIG. 24D, Tap=0.5. In these figures, O represents with no noticeable deterioration; Δ, deterioration noticeable to some extent; and x, noticeable deterioration.

Solid lines in FIGS. 24A–24D represent Ts×log(Cr)=1.3, and dashed lines represent Ts×log(Cr)=0.9. As shown in these figures, an improved motion picture quality was attained if Ts×log(Cr)≦1.3 and the motion picture quality was improved to a level of substantially no noticeable deterioration if Ts×log(Cr)≦0.9.

EXAMPLE 16

Liquid crystal display apparatus prepared in Example 10 were driven while changing Tap and $\tau_{off}$ similarly as in Example 10 and further changing the luminance of the backlight and the transmittance of the liquid crystal to examine the influence of contrast Cr on motion picture quality. Binary picture display was performed similarly as in Example 10.

The picture display speed was changed in various manners with an average of 12 deg./sec. The liquid crystal display devices were driven under the conditions of a display luminance of 150 cd/m$^2$, and a distance of 30 cm from the viewer to the pawl.

As a result, identical evaluation results were obtained as in Example 15 for identical values of $\tau_{off}$ and Tap, so that an improved motion picture quality was attained if Ts×log(Cr) ≦1.3 and the motion picture quality was improved to a level of substantially no noticeable deterioration if Ts×log(Cr) ≦0.9.

As described above, according to the present invention, it is possible to provide an improved motion picture quality depending on the responsiveness of the liquid crystal and the backlight source, so that a certain lever or higher of good motion picture quality is ensured. Further, it is also possible to improve the motion picture quality depending on the pixel size, display luminance and contrast, so that good motion picture quality can be always displayed corresponding to various design changes. Accordingly, the liquid crystal display apparatus of the present invention is suitably applicable to a display apparatus principally intended to display motion pictures, such as television pictures.

What is claimed is:

1. A liquid crystal display apparatus, comprising:

a liquid crystal device including a pair of substrates and a layer of liquid crystal disposed between the substrates so as to form a matrix of pixels, and drive means for driving each pixel in a succession of frame periods each having a duration, in milliseconds, of Fr and divided into a first period and a second period in succession so as to display a first luminance corresponding to given picture data at the pixel in the first period and a second luminance below or equal to the first luminance and common to all the pixels in the second period under a condition satisfying: $Tap+(\tau_{off}-\tau_{on})/2Fr=Ts\leqq 0.6$, wherein Tap represents a time aperture ratio determined as a ratio between the first period and one frame period Fr, $\tau_{on}$ represents a rise time, in milliseconds, required for a luminance change of from 0% to 90% during a switching from 0%-luminance to 100%-luminance, and $\tau_{off}$ represents a fall time, in milliseconds, required for a luminance change of from 100% to 10% during switching from 100%-luminance to 0%-luminance based on a normalized luminance scale with 100% at a maximum luminance and 0% at a minimum luminance of each pixel, wherein Ts is set to be equal to all the pixels.

2. A display apparatus according to claim 1, wherein the first luminance in the first period is given by a first transmittance through the liquid crystal layer corresponding to given picture data at the pixel and the second luminance in the second period is given as a transmittance lower than the first transmittance through the liquid crystal layer, so that the $\tau_{on}$ (ms) and $\tau_{off}$ (ms) are determined based on transmittance changes corresponding to the luminance changes.

3. A display apparatus according to claim 2, wherein the parameter Ts is set to at most 0.45.

4. A display apparatus according to claim 2, wherein the parameter Ts is set to further satisfy a condition of $$Ts\times Sz/(300\times 10^{-6})\leqq 0.6,$$

wherein Sz represents a lateral size of a display unit pixel.

5. A display apparatus according to claim 2, wherein the parameter Ts is set to further satisfy a condition of $$Ts\times log(Br)\leqq 1.3$$

wherein Br represents a display luminance on the liquid crystal device.

6. A display apparatus according to claim 2, wherein the parameter Ts is set to further satisfy a condition of $$Ts\times log(Cr)\leqq 1.2,$$

wherein Cr represents a display contrast at each pixel.

7. The display apparatus according to claim 2, wherein the liquid crystal device is an active matrix-type liquid crystal device wherein each pixel is provided with an active element.

8. The display apparatus according to claim 2, wherein the liquid crystal is a smectic liquid crystal having a spontaneous polarization.

9. The display apparatus according to claim 2, wherein the liquid crystal is a nematic liquid crystal and assumes a bend alignment state wherein liquid crystal molecules have a pretilt angle at boundaries with the substrates and are parallel to a normal to the substrates in a middle portion in the liquid crystal layer in the normal direction.

10. The display apparatus according to claim 2, wherein said liquid crystal display apparatus is a transmission type liquid crystal display apparatus further including a backlight source, and the backlight source is continually placed in an ON-state.

11. The display apparatus according to claim 2, wherein said second luminance in the second period is set to the minimum luminance of 0%.

12. The display apparatus according to claim 1, wherein said liquid crystal display apparatus further includes a backlight source, the first luminance is given by illuminating the pixel in a transmittance state corresponding to given gradation data with light from the backlight source turned on in the first period, and the second luminance is given by turning off the backlight source, so that the $\tau_{on}$ (ms) and $\tau_{off}$ (ms) are determined based on luminance changes of the backlight source.

13. A display apparatus according to claim 12, wherein the parameter Ts is set to at most 0.45.

14. A display apparatus according to claim 12, wherein the parameter Ts is set to further satisfy a condition of $$Ts\times Sz/(300\times 10^{-6})\leqq 0.6,$$

wherein Sz represents a lateral size of a display unit pixel.

15. A display apparatus according to claim 12, wherein the parameter Ts is set to further satisfy a condition of $Ts \times \log(Br) \leqq 1.3$, wherein Br represents a display luminance on the liquid crystal device.

16. A display apparatus according to claim 12, wherein the parameter Ts is set to further satisfy a condition of $$Ts \times \log(Cr) \leqq 1.2,$$

wherein Cr represents a display contrast at each pixel.

17. The display apparatus according to claim 12, wherein the liquid crystal device is an active matrix-type liquid crystal device wherein each pixel is provided with an active element.

18. The display apparatus according to claim 12, wherein the liquid crystal is a smectic liquid crystal having a spontaneous polarization.

19. The display apparatus according to claim 12, wherein the liquid crystal is a nematic liquid crystal and assumes a bend alignment state wherein liquid crystal molecules have a pretilt angle at boundaries with the substrates and are parallel to a normal to the substrates in a middle portion in the liquid crystal layer in the normal direction.

20. The display apparatus according to claim 12, wherein said second luminance in the second period is set to the minimum luminance of 0%.

* * * * *

UNITED STATES PATENT AND TRADEMARK OFFICE

CERTIFICATE OF CORRECTION

PATENT NO. : 6,456,266 B1
DATED : September 24, 2002
INVENTOR(S) : Jun Iba et al.

It is certified that error appears in the above-identified patent and that said Letters Patent is hereby corrected as shown below:

Column 1,
Line 54, “oh” should read -- on --.

Column 2,
Line 9, “as-to” should read -- as to --.

Column 3,
Line 49, “doff” should read -- $\tau_{off}$ --;
Line 52, “doff” should read -- $\tau_{off}$ --.

Column 4,
Line 43, “=TapxFr+($\tau_{off}$-$\tau_{on}$)/2Fr,” should read -- =TapxFr+($\tau_{off}$-$\tau_{on}$)/2, --.

Column 5,
Line 42, “Ton” should read -- $\tau_{on}$ --.

Column 8,
Line 12, “are-realigned” should read -- are realigned --.

Column 11,
Line 47, “system,-the” should read -- system, the --;
Line 57, “be” should be deleted.

Column 12,
Line 67, “fist” should read -- first --.

Column 13,
Line 36, “show” should read -- shown --;
Line 45, “ode” should read -- mode --;
Line 48, ““KN5015”,” should read -- (“KN5015”, --.

Column 16,
Line 2, “pawl.” should read -- panel. --.

UNITED STATES PATENT AND TRADEMARK OFFICE

CERTIFICATE OF CORRECTION

PATENT NO. : 6,456,266 B1 
DATED : September 24, 2002
INVENTOR(S) : Jun Iba et al.

It is certified that error appears in the above-identified patent and that said Letters Patent is hereby corrected as shown below:

Column 19,
Line 40, "$_6$)=0.65," should read -- $^6$)=0.65, --.

Column 20,
Line 9, "Br (cd/$^2$)" should read -- Br (cd/m$^2$) --.

Column 21,
Line 33, "lever" should read -- level --.

Signed and Sealed this

Twenty-second Day of July, 2003

JAMES E. ROGAN
*Director of the United States Patent and Trademark Office*

US006456266C1

(12) EX PARTE REEXAMINATION CERTIFICATE (5719th)

United States Patent

Iba et al.

(10) Number: US 6,456,266 C1

(45) Certificate Issued: Mar. 20, 2007

(54) LIQUID CRYSTAL DISPLAY APPARATUS

(75) Inventors: Jun Iba, Yokohama (JP); Katsumi Komiyama, Isehara (JP); Shigeyuki Matsumoto, Atsugi (JP)

(73) Assignee: Canon Kabushiki Kaisha, Tokyo (JP)

Reexamination Request:
No. 90/007,159, Aug. 9, 2004

Reexamination Certificate for:

| | |
|---|---|
| Patent No.: | **6,456,266** |
| Issued: | **Sep. 24, 2002** |
| Appl. No.: | **09/343,184** |
| Filed: | **Jun. 30, 1999** |

Certificate of Correction issued Jul. 22, 2003.

(30) Foreign Application Priority Data

Jun. 30, 1998 (JP) ..... 10-184288
Jun. 30, 1998 (JP) ..... 10-184289

(51) Int. Cl.

| | |
|---|---|
| ***G09G 3/36*** | (2006.01) |
| ***G09G 3/34*** | (2006.01) |
| ***G02F 1/1347*** | (2006.01) |

(52) U.S. Cl. ..... 345/87; 345/99; 345/102; 345/210; 345/101; 345/95; 345/96; 345/97; 349/74; 349/61; 378/98.8

(58) Field of Classification Search ..... 345/87, 345/92, 99, 102, 95, 96; 349/138, 140, 142, 349/144, 61, 74

See application file for complete search history.

(56) References Cited

U.S. PATENT DOCUMENTS 5,298,199 A * 3/1994 Hirose et al. ..... 264/2.6
5,745,087 A * 4/1998 Tomiyoshi et al. ..... 345/89

FOREIGN PATENT DOCUMENTS

JP 8-5974 1/1996
JP 9-325715 12/1997

OTHER PUBLICATIONS

Conference Recordings of the 1997 International Display Research Conference and International Workshops on LCD Technology and Emissive Technology, Sep. 1997, L–66 to L–69.

Liquid Crystal Device Handbook, Nikkan Kogyo Shinbun, 2nd printing of 1st edition published Oct. 1990, pp. 568 and 569.

* cited by examiner

*Primary Examiner*—Henry N. Tran

(57) ABSTRACT

The motion picture quality of liquid crystal display apparatus is improved by placing a non-display period depending on the responsiveness of the liquid crystal and a backlight source. For this purpose, a sub-period is set, within one frame period, for displaying a luminance corresponding to prescribed picture data so as to provide a time integral of luminance corresponding to a maximum luminance not exceeding a certain threshold, and another sub-period for displaying a lower luminance is placed in the same one frame period.

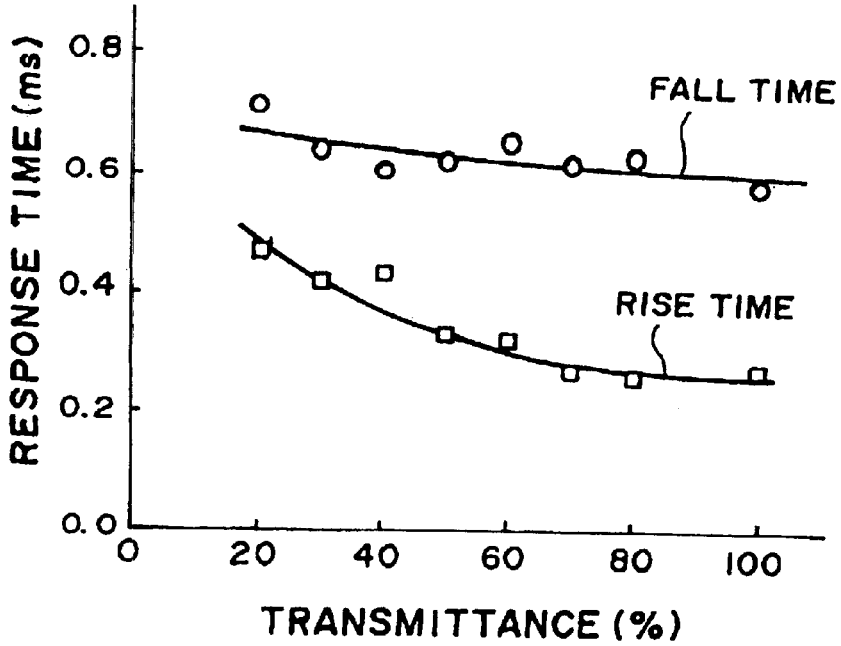

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 12 and 17 are cancelled.

Claims 2–11, 13–16 and 18–20 are determined to be patentable as amended.

New claims 21–24 are added and determined to be patentable.

2. A display apparatus according to claim [1] *21*, wherein the first luminance in the first period is given by a first transmittance through the liquid crystal layer corresponding to given picture data at the pixel and the second luminance in the second period is given as a transmittance lower than the first transmittance through the liquid crystal layer, so that the $\tau_{on}$ (ms) and $\tau_{off}$ (ms) are determined based on transmittance changes corresponding to the luminance changes.

3. A display apparatus according to claim [1] *21*, wherein the parameter Ts is set to at most 0.45.

4. A *liquid crystal* display apparatus [according to claim 2], *comprising:*

*a liquid crystal device including a pair of substrates and a layer of liquid crystal disposed between the substrates so as to form a matrix of pixels, and*

*drive means for driving each pixel in a succession of frame periods each having a duration, in milliseconds, of Fr and divided into a first period and a second period in succession so as to display a first luminance corresponding to given picture data at the pixel in the first period and a second luminance below or equal to the first luminance and common to all the pixels in the second period under a condition satisfying:*

$$Tap+(\tau_{off}-\tau_{on})/2Fr=Ts\leqq 0.6,$$

*wherein Tap represents a time aperture ratio determined as a ratio between the first period and one frame period Fr, $\tau_{on}$ represents a rise time, in milliseconds, required for a luminance change of from 0% to 90% during a switching from 0%-luminance to 100%-luminance, and $\tau_{off}$ represents a fall time, in milliseconds, required for a luminance change of from 100% to 10% during switching from 100%-luminance to 0%-luminance based on a normalized luminance scale with 100% at a maximum luminance and 0% at a minimum luminance of each pixel,*

*wherein Ts is set to be equal to all the pixels,*

*wherein the first luminance in the first period is given by a first transmittance through the liquid crystal layer corresponding to given picture data at the pixel and the second luminance in the second period is given as a transmittance lower than the first transmittance through the liquid crystal layer, so that the $\tau_{on}$ (ms) and $\tau_{off}$ (ms) are determined based on transmittance changes corresponding to the luminance changes, and* wherein the parameter Ts is set to further satisfy a condition of $$Ts\times Sz/(300\times 10^{-6})\leqq 0.6,$$

wherein Sz represents a lateral size of a display unit pixel.

5. A *liquid crystal* display apparatus [according to claim 2], *comprising:*

*a liquid crystal device including a pair of subtrates and a layer of liquid crystal disposed between the substrates so as to form a matrix of pixels, and*

*drive means for driving each pixel in a succession of frame periods each having a duration, in milliseconds, of Fr and divided into a first period and a second period in succession so as to display a first luminance corresponding to given picture data at the pixel in the first period and a second luminance below or equal to the first luminance and common to all the pixels in the second period under a condition satisfying:*

$$Tap+(\tau_{off}-\tau_{on})/2Fr=Ts\leqq 0.6,$$

*wherein Tap represents a time aperture ratio determined as a ratio between the first period and one frame period Fr, $\tau_{on}$ represents a rise time, in milliseconds, required for a luminance change of from 0% to 90% during a switching from 0%-luminance to 100%-luminance, and $\tau_{off}$ represents a fall time, in milliseconds, required for a luminance change of from 100% to 10% during switching from 100%-luminance to 0%-luminance based on a normalized luminance scale with 100% at a maximum luminance and 0% at a minimum luminance of each pixel,*

*wherein Ts is set to be equal to all the pixels, and*

*wherein the first luminance in the first period is given by a first transmittance through the liquid crystal layer corresponding to given picture data at the pixel and the second luminance in the second period is given as a transmittance lower than the first transmittance through the liquid crystal layer, so that the $\tau_{on}$ (ms) and $\tau_{off}$ (ms) are determined based on transmittance changes corresponding to the luminance changes, and* wherein the parameter Ts is set to further satisfy a condition of $$Ts\times\log(Br)\leqq 1.3,$$

wherein Br represents a display luminance on the liquid crystal device.

6. A *liquid crystal* display apparatus [according to claim 2], *comprising:*

*a liquid crystal device including a pair of substrates and a layer of liquid crystal disposed between the substrates so as to form a matrix of pixels, and*

*drive means for driving each pixel in a succession of frame periods each having a duration, in milliseconds, of Fr and divided into a first period and a second period in succession so as to display a first luminance*

*corresponding to given picture data at the pixel in the first period and a second luminance below or equal to the first luminance and common to all the pixels in the second period under a condition satisfying:*

$$Tap+(\tau_{off}-\tau_{on})/2Fr=Ts\leqq 0.6,$$

*wherein Tap represents a time aperture ratio determined as a ratio between the first period and one frame period Fr, $\tau_{on}$ represents a rise time, in milliseconds, required for a luminance change of from 0% to 90% during a switching from 0%-luminance to 100%-luminance, and $\tau_{off}$ represents a fall time, in milliseconds, required for a luminance change of from 100% to 10% during switching from 100%-luminance to 0%-luminance based on a normalized luminance scale with 100% at a maximum luminance and 0% at a minimum luminance of each pixel,*

*wherein Ts is set to be equal to all the pixels,*

*wherein the first luminance in the first period is given by a first transmittance through the liquid crystal layer corresponding to given picture data at the pixel and the second luminance in the second period is given as a transmittance lower than the first transmittance through the liquid crystal layer, so that the $\tau_{on}$ (ms) and $\tau_{off}$ (ms) are determined based on transmittance changes corresponding to the luminance changes, and* wherein the parameter Ts is set to further satisfy a condition of $$Ts\times\log(Cr)\leqq 1.2,$$

wherein Cr represents a display contrast at each pixel.

7. The display apparatus according to claim [2] *21*, wherein the liquid crystal device is an active matrix-type liquid crystal device wherein each pixel is provided with an active element.

8. The display apparatus according to claim [2] *21*, wherein the liquid crystal is a smectic liquid crystal having a spontaneous polarization.

9. The display apparatus according to claim [2] *21*, wherein the liquid crystal is a nematic liquid crystal and assumes a bend alignment state wherein liquid crystal molecules have a pretilt angle at boundaries with the substrates and are parallel to a normal to the substrates in a middle portion in the liquid crystal layer in the normal direction.

10. The display apparatus according to claim [2] *21*, wherein said liquid crystal display apparatus is a transmission type liquid crystal display apparatus further including a backlight source, and the backlight source is continually placed in an ON-state.

11. The display apparatus according to claim [2] *21*, wherein said second luminance in the second period is set to the minimum luminance of 0%.

13. A display according to claim [12] *24*, wherein the parameter Ts is set to at most 0.45.

14. A *liquid crystal* display apparatus [according to claim 12], *comprising:*

*a liquid crystal device including a pair of substrates and a layer of liquid crystal disposed between the substrates so as to form a matrix of pixels, and*

*drive means for driving each pixel in a succession of frame periods each having a duration, in milliseconds, of Fr and divided into a first period and a second period in succession so as to display a first luminance corresponding to given picture data at the pixel in the first period and a second luminance below or equal to the first luminance and common to all the pixels in the second period under a condition satisfying:*

$$Tap+(\tau_{off}-\tau_{on})/2Fr=Ts\leqq 0.6,$$

*wherein Tap represents a time aperture ratio determined as a ratio between the first period and one frame period Fr, $\tau_{on}$ represents a rise time, in milliseconds, required for a luminance change of from 0% to 90% during a switching from 0%-luminance to 100%-luminance, and $\tau_{off}$ represents a fall time, in milliseconds, required for a luminance change of from 100% to 10% during switching from 100%-luminance to 0%-luminance based on a normalized luminance scale with 100% at a maximum luminance and 0% at a minimum luminance of each pixel,*

*wherein Ts is set to be equal to all the pixels, and*

*wherein said liquid crystal display apparatus further includes a backlight source, the first luminance is given by illuminating the pixel in a transmittance state corresponding to given gradation data with light from the backlight source turned on in the first period, and the second luminance is given by turning off the backlight source, so that the $\tau_{on}$ (ms) and $\tau_{off}$ (ms) are determined based on luminance changes of the backlight source, and* wherein the parameter Ts is set to further satisfy a condition of $$Ts\times Sz/(300\times 10^{-6})\leqq 0.6,$$

wherein Sz represents a lateral size of a display unit pixel.

15. A *liquid crystal* display apparatus [according to claim 12], *comprising:*

*a liquid crystal device including a pair of substrates and a layer of liquid crystal disposed between the substrates so as to form a matrix of pixels, and*

*drive means for driving each pixel in a succession of frame periods each having a duration, in milliseconds, of Fr and divided into a first period and a second period in succession so as to display a first luminance corresponding to given picture data at the pixel in the first period and a second luminance below or equal to the first luminance and common to all the pixels in the second period under a condition satisfying:*

$$Tap+(\tau_{off}-\tau_{on})/2Fr=Ts\leqq 0.6,$$

*wherein Tap represents a time aperture ratio determined as a ratio between the first period and one frame period Fr, $\tau_{on}$ represents a rise time, in milliseconds, required for a luminance change of from 0% to 90% during a switching from 0%-luminance to 100%-luminance, and $\tau_{off}$ represents a fall time, in milliseconds, required for a luminance change of from 100% to 10% during switching from 100%-luminance to 0%-luminance based on a normalized luminance scale with 100% at a maximum luminance and 0% at a minimum luminance of each pixel,*

*wherein Ts is set to be equal to all the pixels,*

*wherein said liquid crystal display apparatus further includes a backlight source, the first luminance is given*

*by illuminating the pixel in a transmittance state corresponding to given gradation data with light from the backlight source turned on in the first period, and the second luminance is given by turning off the backlight source, so that the* $\tau_{on}$ *(ms) and* $\tau_{off}$ *(ms) are determined based on luminance changes of the backlight source, and* wherein the parameter Ts is set to further satisfy a condition of $$Ts \times \log(Br) \leqq 1.3,$$

wherein Br represents a display luminance on the liquid crystal device.

16. A *liquid crystal* display apparatus [according to claim 12], *comprising:*

*a liquid crystal device including a pair of substrates and a layer of liquid crystal disposed between the substrates so as to form a matrix of pixels, and*

*drive means for driving each pixel in a succession of frame periods each having a duration, in milliseconds, of Fr and divided into a first period and a second period in succession so as to display a first luminance corresponding to given picture data at the pixel in the first period and a second luminance below or equal to the first luminance and common to all the pixels in the second period under a condition satisfying:*

$$Tap+(\tau_{off}-\tau_{on})/2Fr=Ts \leqq 0.6,$$

*wherein Tap represents a time aperture ratio determined as a ratio between the first period and one frame period Fr,* $\tau_{on}$ *represents a rise time, in milliseconds, required for a luminance change of from 0% to 90% during a switching from 0%-luminance to 100%-luminance, and* $\tau_{off}$ *represents a fall time, in milliseconds, required for a luminance change of from 100% to 10% during switching from 100%-luminance to 0%-luminance based on a normalized luminance scale with 100% at a maximum luminance and 0% at a minimum luminance of each pixel,*

*wherein Ts is set to be equal to all the pixels, and*

*wherein said liquid crystal display apparatus further includes a backlight source, the first luminance is given by illuminating the pixel in a transmittance state corresponding to given gradation data with light from the backlight source turned on in the first period, and the second luminance is given by turning off the backlight source, so that the* $\tau_{on}$ *(ms) and* $\tau_{off}$ *(ms) are determined based on luminance changes of the backlight source, and,* wherein the parameter Ts is set to further satisfy a condition of $$Ts \times \log(Cr) \leqq 1.2,$$

wherein Cr represents a display contrast at each pixel.

18. The display apparatus according to claim [12] *24*, wherein the liquid crystal is a smectic liquid crystal having a spontaneous polarization.

19. The display apparatus according to claim [12] *24*, wherein the liquid crystal is a nematic liquid crystal and assumes a bend alignment state wherein liquid crystal molecules have a pretilt angle at boundaries with the substrates and are parallel to a normal to the substrates in a middle portion in the liquid crystal layer in the normal direction.

20. The display apparatus according to claim [12] *24*, wherein said second luminance in the second period is set to the minimum luminance of 0%.

*21. A liquid crystal display apparatus, comprising:*

*an active-matrix type liquid crystal device having a plurality of pixels, each provided with an active element having a gate electrode and a source electrode, and including a pair of substrates and a layer of liquid crystal disposed between the substrates so as to form a matrix of pixels;*

*scanning signal lines, each connected to a gate electrode of an associated active element;*

*data signal lines, each connected to a source electrode of the associated active element; and*

*drive means for driving each pixel in succession of frame periods each having a duration, in milliseconds, of Fr and divided into a first period and a second period in succession so as to display a first luminance corresponding to given picture data at the pixel in the first period by sequentially selecting said scanning signal lines to apply a scanning signal to said scanning signal lines and, in synchronism with the scanning signal, by applying a data signal to said data signal lines, and so as to display a second luminance below the first luminance and common to all the pixels in the second period by sequentially selecting said scanning signal lines to apply a scanning signal to said scanning signal lines and, in synchronism with the scanning signal, by applying a signal corresponding to the second luminance to said data signal line under a condition satisfying:*

$$Tap+(\tau_{off}-\tau_{on})/2Fr=Ts \leqq 0.6,$$

*wherein Tap represents a time aperture ratio determined as a ratio between the first period and one frame period Fr,* $\tau_{on}$ *represents a rise time, in milliseconds, required for a luminance change of from 0% to 90% during switching from 0%-luminance to 100%-luminance, and* $\tau_{off}$ *represents a fall time, in milliseconds, required for a luminance change of from 100% to 10% during switching from 100%-luminance to 0%-luminance based on a normalized luminance scale with 100% at a maximum luminance and 0% at a minimumn luminance of each pixel,*

*wherein Ts is set to be equal to all the pixels, and wherein said first period is constant at each pixel, and said second period is constant at each pixel.*

*22. A liquid crystal display apparatus, comprising:*

*a liquid crystal device including a pair of substrates and a layer of liquid crystal disposed between the substrates so as to form a matrix of pixels, and*

*drive means for driving each pixel in a succession of frame periods each having a duration, in milliseconds, of Fr and divided into a first period and a second period in succession so as to display a first luminance corresponding to given picture data at*

*the pixel in the first period and a second luminance below the first luminance and common to all the pixels in the second period under a condition satisfying:*

$$Tap+(\tau\ off-\tau\ on)\ /2Fr=Ts<0.6,$$

*wherein Tap represents a time aperture ratio determined as a ratio between the first period and one frame period*

*Fr. τ on represents a rise time, in milliseconds, required for a luminance change of from 0% to 90% during a switching from 0%-luminance to 100%-luminance, and τ off represents a fall time in milliseconds, required for a luminance change of from 100% to 10% during switching from 100%-luminance to 0%-luminance based on—a normalized luminance scale with 100% at a maximum luminance and 0% at a minimum luminance of each pixel,*

*wherein Ts is set to be equal to all the pixels, and τ off is larger than τ on, and wherein said first period is constant at each pixel, and said second period is constant at each pixel.*

*23. A liquid crystal display apparatus, comprising:*

*a liquid crystal device including a pair of substrates and a layer of liquid crystal disposed between the substrates so as to form a matrix of pixels, and*

*drive means for driving each pixel in a succession of frame periods each having a duration, in milliseconds, of Fr and divided into a first period and a second period in succession so as to display a first luminance corresponding to given picture data at the pixel in the first period and a second luminance below the first luminance and common to all the pixels in the second period under a condition satisfying:*

$$Tap+(\tau\ off-\tau\ on)/2Fr=Ts<0.6,$$

*wherein Tap represents a time aperture ratio*

*determined as a ratio between the first period and one frame period Fr. τ on represents a rise time, in milliseconds, required for a luminance change of from 0% to 90% during a switching from 0%-luminance to 100%-luminance, and τ off represents a fall time, in milliseconds, required for a luminance change of from 100% to 10% during switching from 100%-luminance to 0%-luminance based on a normalized luminance scale with 100% at a maximum luminance and 0% at a minimum luminance of each pixel,*

*wherein Ts is set to be equal to all the pixels, and τ off is smaller than τ on, and wherein said first period is constant at each pixel, and said second period is constant at each pixel.*

*24. A liquid crystal display apparatus comprising:*

*an active-matrix type liquid crystal device having a plurality of pixels, each provided with an active element having a gate electrode and a source electrode, and including a pair of substrates and a layer of liquid crystal disposed between the substrates so as to form a matrix of pixels,*

*scanning signal lines, each connected to a gate electrode of an associated active element,*

*data signal lines, each connected to a source electrode of the associated active element, and*

*drive means for driving each pixel in succession of frame periods each having a duration, in milliseconds, of Fr and divided into a first period and a second period in succession so as to display a first luminance corresponding to given picture data at the pixel in the first period without applying a scanning signal to said scanning signal lines and so as to display a second luminance below the first luminance and common to all the pixels in the second period with sequentially selecting said scanning signal lines to apply a scanning signal to said scanning signal lines and, in synchronism with the scanning signal, with applying a data signal corresponding to the first luminance to said data signal line under a condition satisfying:*

$$Tap+(\tau\ off-\tau\ on)/2Fr=Ts<0.6,$$

*wherein Tap represents a time aperture ratio determined as a ratio between the first period and one frame period Fr, τ on represents a rise time, in milliseconds, required for a luminance change of from 0% to 90% during switching from 0%-luminance to 100%-luminance, and τ off represents a fall time, in milliseconds. required for a luminance change o£ from 100% to 10% during switching from 100%-luminance to 0%-luminance based on a normalized luminance scale with 100% at a maximum luminance and 0% at a minimum luminance o£ each pixel,*

*wherein Ts is set to be equal to all the pixels, and the second luminance is provided by off-state of a backlight source, and wherein said first period is constant at each pixel, and said second period is constant at each pixel.*

* * * * *